US010089812B1

(12) United States Patent
Blake et al.

(10) Patent No.: US 10,089,812 B1
(45) Date of Patent: Oct. 2, 2018

(54) SYSTEMS, METHODS AND DEVICES FOR PROCESSING COINS UTILIZING A MULTI-MATERIAL COIN SORTING DISK

(71) Applicant: Cummins-Allison Corp., Mt. Prospect, IL (US)

(72) Inventors: John R. Blake, St Charles, IL (US); Douglas U. Mennie, Barrington, IL (US); David J. Wendell, Darien, IL (US); Ricky Newsom, Bolingbrook, IL (US); James M. Rasmussen, Chicago, IL (US); Marianne L. Krbec, Wood Dale, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 0 days.

(21) Appl. No.: 14/936,829

(22) Filed: Nov. 10, 2015

Related U.S. Application Data

(60) Provisional application No. 62/078,245, filed on Nov. 11, 2014.

(51) Int. Cl.
*G07D 1/00* (2006.01)
*G07D 9/00* (2006.01)
(Continued)

(52) U.S. Cl.
CPC ..... *G07D 9/008* (2013.01); *G07D 1/00* (2013.01); *G07D 3/00* (2013.01); *G07D 3/06* (2013.01); *G07D 3/128* (2013.01)

(58) Field of Classification Search
CPC ..... G07D 3/128; G07D 1/00; G07D 1/02; G07D 1/04; G07D 1/06; G07D 1/08;
(Continued)

(56) References Cited

U.S. PATENT DOCUMENTS 1,099,705 A 6/1914 Lindeen
2,570,920 A 10/1951 Clough et al. ..... 232/16
(Continued)

FOREIGN PATENT DOCUMENTS

CA 2235925 C 11/1995 ..... G07D 9/00
CA 2189330 C 12/2000 ..... G07F 17/42
(Continued)

OTHER PUBLICATIONS

Microblue Literature dated Nov. 18, 2002, cited in U.S. Appl. No. 10/263,477.*
(Continued)

*Primary Examiner* — Jeffrey A Shapiro
(74) *Attorney, Agent, or Firm* — Greer, Burns & Crain, Ltd.

(57) ABSTRACT

Currency processing systems, coin processing machines, and methods of sorting coins with disk-type sorters are presented herein. A currency processing system is disclosed which includes a housing with an input area for receiving coins and receptacles for stowing processed coins. A disk-type coin processing unit is coupled to the coin input area and coin receptacles. The coin processing unit includes a rotatable disk for imparting motion to coins, and a sorting head adjacent the rotatable disk with shaped regions for guiding moving coins to exit channels which sort and discharge coins through exit stations to the coin receptacles. The sorting head includes a plurality of localized inserts that are fabricated from a material or materials which is/are distinct from the material of the sorting head. Each localized insert has a distinct shape and is readily removably attached at a distinct one of various predetermined locations on the sorting head.

28 Claims, 15 Drawing Sheets

(51) Int. Cl.

| | |
|---|---|
| *G07D 3/12* | (2006.01) |
| *G07D 3/00* | (2006.01) |
| *G07D 3/06* | (2006.01) |

(58) Field of Classification Search

CPC .. G07D 3/00; G07D 3/02; G07D 3/06; G07D 3/08; G07D 9/06; G07D 2201/00; B65D 2543/00564; G07F 3/04; G07F 5/24; G07F 9/08; G07F 19/203

USPC .... 453/6, 10, 12, 13, 33, 34, 35, 49, 57, 11; 220/217, 221, 222, 224, 234–237, 295, 220/304, 795, 310.1, 345.6, 803, 804, 220/806, 378; 194/206, 207, 350; 209/534; 235/379; 382/135, 136; 361/825

See application file for complete search history.

(56) References Cited

U.S. PATENT DOCUMENTS

| | | | | |
|---|---|---|---|---|
| 2,669,998 | A | 2/1954 | Buchholz | 133/8 |
| 2,750,949 | A | 6/1956 | Kulo et al. | 133/8 |
| 2,835,260 | A | 5/1958 | Buchholz | 133/8 |
| 2,865,561 | A | 12/1958 | Rosapepe | 232/7 |
| 3,132,654 | A | 5/1964 | Adams | 133/1 |
| 3,376,970 | A | 4/1968 | Roseberg | 198/40 |
| 3,771,583 | A | 11/1973 | Bottemiller | 160/327 |
| 3,778,595 | A | 12/1973 | Hatanaka et al. | 235/61.7 B |
| 3,851,755 | A | 12/1974 | Hull et al. | 206/0.82 |
| 3,916,922 | A | 11/1975 | Prumm | 133/3 R |
| 3,998,237 | A | 12/1976 | Kressin | 133/3 A |
| 3,998,379 | A | 12/1976 | Myers et al. | 229/33 |
| 4,050,218 | A | 9/1977 | Call | 53/167 |
| 4,059,122 | A | 11/1977 | Kinoshita | 133/3 D |
| 4,075,460 | A | 2/1978 | Gorgens | 235/420 |
| 4,124,111 | A | 11/1978 | Hayashi | 194/102 |
| 4,150,740 | A | 4/1979 | Douno | 194/4 C |
| 4,166,945 | A | 9/1979 | Inoyama et al. | 235/379 |
| 4,172,462 | A | 10/1979 | Uchida et al. | 133/3 A |
| 4,179,685 | A | 12/1979 | O'Maley | 340/146.3 H |
| 4,179,723 | A | 12/1979 | Spencer | 361/384 |
| 4,184,366 | A | 1/1980 | Butler | 73/163 |
| 4,197,986 | A | 4/1980 | Nagata | 235/379 |
| 4,208,549 | A | 6/1980 | Polillo et al. | 179/6.3 R |
| 4,228,812 | A | 10/1980 | Marti | 133/3 F |
| 4,232,295 | A | 11/1980 | McConnell | 340/152 R |
| 4,234,003 | A | 11/1980 | Ristvedt et al. | 133/3 |
| 4,249,552 | A | 2/1981 | Margolin et al. | 133/1 R |
| 4,251,867 | A | 2/1981 | Uchida et al. | 364/408 |
| 4,286,703 | A | 9/1981 | Schuller et al. | 194/100 A |
| RE30,773 | E | 10/1981 | Glaser et al. | 235/379 |
| 4,310,885 | A | 1/1982 | Azcua et al. | 364/405 |
| 4,317,957 | A | 3/1982 | Sendrow | 178/22.08 |
| 4,341,951 | A | 7/1982 | Benton | 235/379 |
| 4,355,369 | A | 10/1982 | Garvin | 364/900 |
| 4,360,034 | A | 11/1982 | Davila et al. | 133/3 D |
| 4,369,442 | A | 1/1983 | Werth et al. | 340/825.35 |
| 4,380,316 | A | 4/1983 | Glinka et al. | 232/16 |
| 4,383,540 | A | 5/1983 | DeMeyer et al. | 133/3 H |
| 4,385,285 | A | 5/1983 | Horst et al. | 382/3 |
| 4,412,292 | A | 10/1983 | Sedam et al. | 364/479 |
| 4,416,299 | A | 11/1983 | Bergman | 133/1 R |
| 4,417,136 | A | 11/1983 | Rushby et al. | 235/379 |
| 4,423,316 | A | 12/1983 | Sano et al. | 235/379 |
| 4,434,359 | A | 2/1984 | Watanabe | 235/379 |
| 4,436,103 | A | 3/1984 | Dick | 133/3 D |
| 4,454,414 | A | 6/1984 | Benton | 235/379 |
| 4,474,197 | A | 10/1984 | Kinoshita et al. | 133/4 A |
| 4,488,116 | A | 12/1984 | Plesko | 324/236 |
| 4,531,531 | A | 7/1985 | Johnson et al. | 133/3 |
| 4,543,969 | A * | 10/1985 | Rasmussen | G07D 3/128 453/10 |
| 4,549,561 | A | 10/1985 | Johnson et al. | 133/3 |
| 4,556,140 | A | 12/1985 | Okada | 194/4 C |
| 4,558,711 | A | 12/1985 | Yoshiaki et al. | 133/3 F |
| 4,564,036 | A | 1/1986 | Ristvedt | 133/3 |
| 4,570,655 | A | 2/1986 | Raterman | 133/3 |
| 4,594,664 | A | 6/1986 | Hashimoto | 364/405 |
| 4,602,332 | A | 7/1986 | Hirose et al. | 364/408 |
| 4,607,649 | A | 8/1986 | Taipale et al. | 133/3 C |
| 4,620,559 | A | 11/1986 | Childers et al. | 133/3 R |
| 4,641,239 | A | 2/1987 | Takesako | 364/408 |
| 4,674,260 | A | 6/1987 | Rasmussen et al. | 53/212 |
| 4,681,128 | A | 7/1987 | Ristvedt et al. | 453/6 |
| 4,705,154 | A | 11/1987 | Masho et al. | 194/319 |
| 4,718,218 | A | 1/1988 | Ristvedt | 53/532 |
| 4,731,043 | A | 3/1988 | Ristvedt et al. | 453/6 |
| 4,733,765 | A | 3/1988 | Watanabe | 194/206 |
| 4,749,074 | A | 6/1988 | Ueki et al. | 194/317 |
| 4,753,624 | A | 6/1988 | Adams et al. | 453/10 |
| 4,753,625 | A | 6/1988 | Okada | 453/32 |
| 4,765,464 | A | 8/1988 | Ristvedt | 206/0.82 |
| 4,766,548 | A | 8/1988 | Cedrone et al. | 364/479 |
| 4,767,090 | A * | 8/1988 | Hartman | F16M 11/16 24/273 |
| 4,775,353 | A | 10/1988 | Childers et al. | 453/6 |
| 4,775,354 | A | 10/1988 | Rasmussen et al. | 453/10 |
| 4,778,983 | A | 10/1988 | Ushikubo | 235/381 |
| 4,803,347 | A | 2/1989 | Sugahara et al. | 235/379 |
| 4,804,830 | A | 2/1989 | Miyagisima et al. | 235/379 |
| 4,812,629 | A | 3/1989 | O'Neil et al. | 235/383 |
| 4,839,505 | A | 6/1989 | Bradt et al. | 235/381 |
| 4,840,290 | A | 6/1989 | Nakamura | 221/10 |
| 4,844,369 | A | 7/1989 | Kanayachi | 242/56 R |
| 4,848,556 | A | 7/1989 | Shah et al. | 194/212 |
| 4,863,414 | A | 9/1989 | Ristvedt et al. | 453/6 |
| 4,883,158 | A | 11/1989 | Kobayashi et al. | 194/217 |
| 4,884,212 | A | 11/1989 | Stutsman | 364/479 |
| 4,900,909 | A | 2/1990 | Nagashima et al. | 235/487 |
| 4,908,516 | A | 3/1990 | West | 250/556 |
| 4,921,463 | A | 5/1990 | Primdahl et al. | 453/3 |
| 4,936,435 | A | 6/1990 | Griner | 194/317 |
| 4,953,086 | A | 8/1990 | Fukatsu | 364/408 |
| 4,954,697 | A | 9/1990 | Kokubun et al. | 235/381 |
| 4,964,495 | A | 10/1990 | Rasmussen | 194/344 |
| 4,966,570 | A | 10/1990 | Ristvedt et al. | 453/6 |
| 4,970,655 | A | 11/1990 | Winn et al. | 364/479 |
| 4,971,187 | A | 11/1990 | Furuya et al. | 194/318 |
| 4,988,849 | A | 1/1991 | Sasaki et al. | 235/379 |
| 4,992,647 | A | 2/1991 | Konishi et al. | 235/379 |
| 4,995,848 | A | 2/1991 | Goh | 453/3 |
| 5,009,627 | A | 4/1991 | Rasmussen | 453/10 |
| 5,010,238 | A | 4/1991 | Kadono et al. | 235/379 |
| 5,010,485 | A | 4/1991 | Bigari | 364/408 |
| 5,011,455 | A | 4/1991 | Rasmussen | 453/10 |
| 5,022,889 | A | 6/1991 | Ristvedt et al. | 453/6 |
| 5,025,139 | A | 6/1991 | Halliburton, Jr. | 235/379 |
| 5,026,320 | A | 6/1991 | Rasmussen | 453/6 |
| 5,031,098 | A | 7/1991 | Miller et al. | 364/405 |
| 5,033,602 | A | 7/1991 | Saarinen et al. | 194/334 |
| 5,039,848 | A | 8/1991 | Stoken | 235/381 |
| 5,055,086 | A | 10/1991 | Raterman et al. | 453/10 |
| 5,055,657 | A | 10/1991 | Miller et al. | 235/381 |
| 5,056,643 | A | 10/1991 | Kirberg | 194/202 |
| 5,064,999 | A | 11/1991 | Okamoto et al. | 235/379 |
| 5,067,928 | A | 11/1991 | Harris | 453/17 |
| 5,080,633 | A | 1/1992 | Ristvedt et al. | 435/6 |
| 5,091,713 | A | 2/1992 | Horne et al. | 340/541 |
| 5,104,353 | A | 4/1992 | Ristvedt et al. | 453/6 |
| 5,105,601 | A | 4/1992 | Horiguchi et al. | 53/465 |
| 5,106,338 | A | 4/1992 | Rasmussen et al. | 453/10 |
| 5,111,927 | A | 5/1992 | Schulze | 194/209 |
| 5,114,381 | A | 5/1992 | Ueda et al. | 453/57 |
| 5,120,945 | A | 6/1992 | Nishibe et al. | 235/379 |
| 5,123,873 | A | 6/1992 | Rasmussen | 453/10 |
| 5,129,205 | A | 7/1992 | Rasmussen | 53/52 |
| 5,135,435 | A | 8/1992 | Rasmussen | 453/56 |
| 5,140,517 | A | 8/1992 | Nagata et al. | 364/408 |
| 5,141,443 | A | 8/1992 | Rasmussen et al. | 453/10 |
| 5,141,472 | A | 8/1992 | Todd et al. | 453/10 |
| 5,145,455 | A | 9/1992 | Todd | 453/6 |
| 5,146,067 | A | 9/1992 | Sloan et al. | 235/381 |
| 5,154,272 | A | 10/1992 | Nishiumi et al. | 194/318 |

(56) References Cited

U.S. PATENT DOCUMENTS 5,163,866 A 11/1992 Rasmussen ..... 453/10
5,163,867 A 11/1992 Rasmussen ..... 453/10
5,163,868 A 11/1992 Adams et al. ..... 453/11
5,167,313 A 12/1992 Dobbins et al. ..... 194/317
5,167,571 A * 12/1992 Waller ..... G07D 9/008 453/29
5,175,416 A 12/1992 Mansvelt et al. ..... 235/379
5,176,565 A 1/1993 Ristvedt et al. ..... 453/6
5,179,517 A 1/1993 Sarbin et al. ..... 364/410
5,183,142 A 2/1993 Latchinian et al. ..... 194/206
5,184,709 A 2/1993 Nishiumi et al. ..... 194/318
5,194,037 A 3/1993 Jones et al. ..... 453/10
5,197,919 A 3/1993 Geib et al. ..... 453/10
5,205,780 A 4/1993 Rasmussen ..... 453/10
5,207,784 A 5/1993 Schwartzendruber ..... 221/6
5,209,696 A 5/1993 Rasmussen et al. ..... 453/10
5,236,071 A 8/1993 Lee ..... 194/200
5,243,174 A 9/1993 Veeneman et al. ..... 235/381
5,251,738 A 10/1993 Dabrowski ..... 194/206
5,252,811 A 10/1993 Henochowicz et al. ..... 235/379
5,253,167 A 10/1993 Yoshida et al. ..... 364/408
5,259,491 A 11/1993 Ward, II ..... 194/350
5,263,566 A 11/1993 Nara et al. ..... 194/318
5,265,874 A 11/1993 Dickinson et al. ..... 273/138 A
5,268,561 A 12/1993 Kimura et al. ..... 235/384
5,277,651 A 1/1994 Rasmussen et al. ..... 453/10
5,282,127 A 1/1994 Mii ..... 364/130
5,286,226 A 2/1994 Rasmussen ..... 453/10
5,286,954 A 2/1994 Sato et al. ..... 235/379
5,291,003 A 3/1994 Avnet et al. ..... 235/381
5,291,560 A 3/1994 Daugman ..... 382/2
5,293,981 A 3/1994 Abe et al. ..... 194/345
5,297,030 A 3/1994 Vassigh et al. ..... 364/405
5,297,598 A 3/1994 Rasmussen ..... 141/314
5,297,986 A 3/1994 Ristvedt et al. ..... 453/6
5,299,977 A 4/1994 Mazur et al. ..... 453/10
5,302,811 A 4/1994 Fukatsu ..... 235/381
5,324,922 A 6/1994 Roberts ..... 235/375
5,326,104 A 7/1994 Pease et al. ..... 273/138 A
5,370,575 A 12/1994 Geib et al. ..... 453/3
5,372,542 A 12/1994 Geib et al. ..... 453/10
5,374,814 A 12/1994 Kako et al. ..... 235/379
5,379,344 A 1/1995 Larson et al. ..... 380/23
5,379,875 A 1/1995 Shames et al. ..... 194/317
5,382,191 A 1/1995 Rasmussen ..... 453/11
5,390,776 A 2/1995 Thompson ..... 194/346
5,401,211 A 3/1995 Geib et al. ..... 453/10
5,404,986 A 4/1995 Hossfield et al. ..... 194/317
5,410,590 A 4/1995 Blood et al. ..... 379/147
RE34,934 E 5/1995 Raterman et al. ..... 453/10
5,425,669 A 6/1995 Geib et al. ..... 453/10
5,429,550 A 7/1995 Mazur et al. ..... 453/10
5,440,108 A 8/1995 Tran et al. ..... 235/381
5,443,419 A 8/1995 Adams et al. ..... 453/17
5,450,938 A 9/1995 Rademacher ..... 194/206
5,453,047 A 9/1995 Mazur et al. ..... 453/10
5,458,285 A 10/1995 Remien ..... 232/15
5,468,182 A 11/1995 Geib ..... 453/10
5,470,079 A 11/1995 LeStrange et al. ..... 273/138 A
5,472,381 A * 12/1995 Ayre, Jr. ..... A63D 1/04 473/115
5,474,495 A 12/1995 Geib et al. ..... 453/3
5,474,497 A 12/1995 Jones et al. ..... 453/17
5,480,348 A 1/1996 Mazur et al. ..... 453/10
5,481,790 A * 1/1996 Koreis ..... B01J 3/004 220/242
5,489,237 A 2/1996 Geib et al. ..... 453/12
5,500,514 A 3/1996 Veeneman et al. ..... 235/381
5,501,631 A * 3/1996 Mennie ..... G07D 3/02 453/10
5,507,379 A 4/1996 Mazur et al. ..... 194/318
5,514,034 A 5/1996 Jones et al. ..... 453/10
5,520,577 A 5/1996 Rasmussen ..... 453/56
5,531,309 A 7/1996 Kloss et al. ..... 194/202
5,538,468 A 7/1996 Ristvedt et al. ..... 453/3
5,542,880 A 8/1996 Geib et al. ..... 453/10
5,542,881 A 8/1996 Geib ..... 453/10
5,553,320 A 9/1996 Matsuura et al. ..... 235/379
5,559,887 A 9/1996 Davis et al. ..... 380/24
5,564,546 A 10/1996 Molbak et al. ..... 194/216
5,564,974 A 10/1996 Mazur et al. ..... 453/10
5,564,978 A 10/1996 Jones et al. ..... 453/17
5,570,465 A 10/1996 Tsakanikas ..... 395/114
5,573,457 A 11/1996 Watts et al. ..... 453/31
5,584,758 A 12/1996 Geib ..... 453/10
5,592,377 A 1/1997 Lipkin ..... 395/242
5,602,933 A 2/1997 Blackwell et al. ..... 382/116
5,615,625 A 4/1997 Cassidy et al. ..... 109/45
5,620,079 A 4/1997 Molbak ..... 194/217
5,623,547 A 4/1997 Jones et al. ..... 380/24
5,625,562 A 4/1997 Veeneman et al. ..... 364/479.05
5,630,494 A 5/1997 Strauts ..... 194/317
5,641,050 A 6/1997 Smith et al. ..... 194/210
5,650,605 A 7/1997 Morioka et al. ..... 235/379
5,650,761 A 7/1997 Gomm et al. ..... 235/381
5,652,421 A 7/1997 Veeneman et al. ..... 235/381
5,665,952 A 9/1997 Ziarno ..... 235/380
5,679,070 A 10/1997 Ishida et al. ..... 453/41
5,684,597 A 11/1997 Hossfield et al. ..... 356/384
5,696,366 A 12/1997 Ziarno ..... 235/380
5,743,373 A 4/1998 Strauts ..... 194/318
5,746,299 A 5/1998 Molbak et al. ..... 194/200
5,774,874 A 6/1998 Veeneman et al. ..... 705/27
5,782,686 A 7/1998 Geib et al. ..... 453/10
5,799,767 A 9/1998 Molbak ..... 194/217
5,813,510 A 9/1998 Rademacher ..... 194/206
5,823,315 A 10/1998 Hoffman et al. ..... 194/203
5,830,054 A 11/1998 Petri ..... 453/5
5,838,812 A 11/1998 Pare, Jr. et al. ..... 382/115
5,842,188 A 11/1998 Ramsey et al. ..... 705/416
5,842,916 A 12/1998 Gerrity et al. ..... 453/57
5,850,076 A 12/1998 Morioka et al. ..... 235/379
5,854,581 A 12/1998 Mori et al. ..... 235/379
5,865,673 A 2/1999 Geib et al. ..... 453/10
5,875,879 A 3/1999 Hawthorn ..... 194/350
5,880,444 A 3/1999 Shibata et al. ..... 235/379
5,892,211 A 4/1999 Davis et al. ..... 235/380
5,892,827 A 4/1999 Beach et al. ..... 380/24
5,909,793 A 6/1999 Beach et al. ..... 194/210
5,909,794 A 6/1999 Molbak et al. ..... 194/216
5,913,399 A 6/1999 Takemoto et al. ..... 194/200
5,918,748 A 7/1999 Clark et al. ..... 209/534
5,940,623 A 8/1999 Watts et al. ..... 395/712
5,941,364 A 8/1999 Wei ..... 194/350
5,944,162 A 8/1999 Filiberti ..... 194/204
5,944,600 A 8/1999 Zimmermann ..... 435/10
5,944,601 A 8/1999 Hayashi et al. ..... 453/61
5,951,476 A 9/1999 Beach et al. ..... 600/437
5,957,262 A 9/1999 Molbak et al. ..... 194/200
5,988,348 A 11/1999 Martin et al. ..... 194/317
5,995,949 A 11/1999 Morioka et al. ..... 705/43
5,997,395 A 12/1999 Geib et al. ..... 453/10
6,017,270 A 1/2000 Ristvedt et al. ..... 453/5
6,021,883 A 2/2000 Casanova et al. ..... 194/217
6,032,859 A 3/2000 Muehlberger et al. ..... 235/449
6,039,644 A 3/2000 Geib et al. ..... 453/10
6,039,645 A 3/2000 Mazur ..... 453/10
6,042,470 A 3/2000 Geib et al. ..... 453/10
6,047,807 A 4/2000 Molbak ..... 194/217
6,047,808 A 4/2000 Neubarth et al. ..... 194/317
6,056,104 A 5/2000 Neubarth et al. ..... 194/317
6,080,056 A 6/2000 Karlsson ..... 453/3
6,082,519 A 7/2000 Martin et al. ..... 194/350
6,086,471 A 7/2000 Zimmermann ..... 453/3
6,095,313 A 8/2000 Molbak et al. ..... 194/344
6,116,402 A 9/2000 Beach et al. ..... 194/216
6,131,625 A 10/2000 Casanova et al. ..... 141/314
6,139,418 A 10/2000 Geib et al. ..... 453/10
6,142,285 A 11/2000 Panzeri et al. ..... 194/328
6,145,738 A 11/2000 Stinson et al. ..... 235/379
6,154,879 A 11/2000 Pare, Jr. et al. ..... 902/3
6,168,001 B1 * 1/2001 Davis ..... G07D 3/14 194/200
6,171,182 B1 1/2001 Geib et al. ..... 453/10

(56) References Cited

U.S. PATENT DOCUMENTS 6,174,230 B1 1/2001 Gerrity et al. ..... 453/57
6,196,371 B1 3/2001 Martin et al. ..... 194/317
6,196,913 B1 3/2001 Geib et al. ..... 453/10
6,202,006 B1 3/2001 Scott ..... 700/231
6,213,277 B1 4/2001 Blad et al. ..... 194/350
6,230,928 B1 5/2001 Hanna et al. ..... 221/13
6,264,545 B1 7/2001 Magee et al. ..... 453/3
6,308,887 B1 10/2001 Korman et al. ..... 235/379
6,318,536 B1 11/2001 Korman et al. ..... 194/217
6,318,537 B1 11/2001 Jones et al. ..... 194/346
6,349,972 B1 2/2002 Geiger et al. ..... 283/67
6,386,323 B1 5/2002 Ramachandran et al. ..... 186/36
6,412,620 B1 7/2002 Imura ..... 194/317
6,431,342 B1 8/2002 Schwartz ..... 194/346
6,438,230 B1 8/2002 Moore ..... 380/42
6,456,928 B1 9/2002 Johnson ..... 701/114
6,471,030 B1 10/2002 Neubarth et al. ..... 194/317
6,474,548 B1 11/2002 Montross et al. ..... 235/379
6,484,863 B1 11/2002 Molbak ..... 194/216
6,484,884 B1 11/2002 Gerrity et al. ..... 209/233
6,494,776 B1 12/2002 Molbak ..... 453/32
6,499,277 B1 12/2002 Warner et al. ..... 53/447
6,503,138 B2 1/2003 Spoehr et al. ..... 453/10
6,520,308 B1 * 2/2003 Martin ..... G07D 3/06 194/317
6,522,772 B1 2/2003 Morrison et al. ..... 382/124
6,547,131 B1 4/2003 Foodman et al. ..... 235/380
6,552,781 B1 4/2003 Rompel et al. ..... 256/71
6,554,185 B1 4/2003 Montross et al. ..... 235/379
6,579,165 B2 6/2003 Kuhlin et al. ..... 453/3
6,581,042 B2 6/2003 Pare, Jr. et al. ..... 705/40
6,602,125 B2 8/2003 Martin ..... 453/12
6,609,604 B1 8/2003 Jones et al. ..... 194/302
6,612,921 B2 9/2003 Geib et al. ..... 453/13
6,637,576 B1 10/2003 Jones et al. ..... 194/216
6,640,956 B1 11/2003 Zwieg et al. ..... 194/328
6,644,696 B2 11/2003 Brown et al. ..... 283/67
6,652,380 B1 11/2003 Luciano ..... 463/25
6,655,585 B2 12/2003 Shinn ..... 235/382
6,659,259 B2 12/2003 Knox et al. ..... 194/217
6,662,166 B2 12/2003 Pare, Jr. et al. ..... 705/39
6,663,675 B2 12/2003 Blake et al. ..... 753/63
6,666,318 B2 12/2003 Gerrity et al. ..... 194/347
6,719,121 B2 4/2004 Alexander et al. ..... 194/350
6,755,730 B2 6/2004 Geib et al. ..... 453/3
6,758,316 B2 7/2004 Molbak ..... 194/200
6,761,308 B1 7/2004 Hanna et al. ..... 235/379
6,766,892 B2 7/2004 Martin et al. ..... 194/317
6,783,452 B2 * 8/2004 Hino ..... G07D 3/00 209/3.1
6,786,398 B1 9/2004 Stinson et al. ..... 235/379
6,854,581 B2 2/2005 Molbak ..... 194/344
6,854,640 B2 2/2005 Peklo ..... 235/100
6,863,168 B1 3/2005 Gerrity et al. ..... 194/347
6,892,871 B2 5/2005 Strauts et al. ..... 194/302
6,896,118 B2 5/2005 Jones et al. ..... 194/217
6,928,546 B1 8/2005 Nanavati et al. ..... 713/186
6,950,810 B2 9/2005 Lapsley et al. ..... 705/78
6,953,150 B2 10/2005 Shepley et al. ..... 235/379
6,957,746 B2 10/2005 Martin et al. ..... 221/131
6,966,417 B2 11/2005 Peklo et al. ..... 194/344
6,976,570 B2 12/2005 Molbak ..... 194/215
6,977,096 B2 * 12/2005 LeClaire ..... C23C 4/02 427/180
6,988,606 B2 1/2006 Geib et al. ..... 194/334
6,991,530 B2 * 1/2006 Hino ..... G07D 3/00 194/346
7,004,831 B2 2/2006 Hino et al. ..... 453/5
7,014,029 B2 3/2006 Winters ..... 194/302
7,014,108 B2 3/2006 Sorenson et al. ..... 235/381
7,017,729 B2 3/2006 Gerrity et al. ..... 194/347
7,018,286 B2 3/2006 Blake et al. ..... 453/61
7,028,827 B1 4/2006 Molbak et al. ..... 194/346
7,036,651 B2 5/2006 Tam et al. ..... 194/217
7,083,036 B2 8/2006 Adams ..... 194/223
7,113,929 B1 9/2006 Beach et al. ..... 705/65
7,131,580 B2 11/2006 Molbak ..... 235/379
7,149,336 B2 12/2006 Jones et al. ..... 382/135
7,152,727 B2 12/2006 Waechter ..... 194/317
7,158,662 B2 1/2007 Chiles ..... 382/135
7,188,720 B2 3/2007 Geib et al. ..... 194/302
7,213,697 B2 5/2007 Martin et al. ..... 194/317
7,243,773 B2 7/2007 Bochonok et al. ..... 194/350
7,269,279 B2 9/2007 Chiles ..... 382/135
7,303,119 B2 12/2007 Molbak ..... 235/379
7,331,521 B2 2/2008 Sorenson et al. ..... 235/381
7,337,890 B2 3/2008 Bochonok et al. ..... 194/353
7,427,230 B2 * 9/2008 Blake ..... G07D 3/128 194/342
7,438,172 B2 10/2008 Long et al. ..... 194/347
7,464,802 B2 12/2008 Gerrity et al. ..... 194/347
7,500,568 B2 3/2009 Cousin ..... 209/534
7,520,374 B2 4/2009 Martin et al. ..... 194/317
7,551,764 B2 6/2009 Chiles et al. ..... 382/135
7,552,810 B2 6/2009 Mecklenburg ..... 194/317
7,580,859 B2 8/2009 Economy ..... 705/16
7,604,107 B2 10/2009 Richard et al. ..... 194/351
7,654,450 B2 2/2010 Mateen et al. ..... 235/379
7,658,270 B2 2/2010 Bochonok et al. ..... 194/350
7,735,125 B1 6/2010 Alvarez et al. ..... 726/9
7,743,902 B2 6/2010 Wendell et al. ..... 194/302
7,778,456 B2 8/2010 Jones et al. ..... 382/135
7,819,308 B2 10/2010 Osterberg et al. ..... 235/379
7,874,478 B2 1/2011 Molbak ..... 235/379
7,886,890 B2 2/2011 Blake et al. ..... 194/347
7,931,304 B2 4/2011 Brown et al. ..... 283/57
7,946,406 B2 5/2011 Blake et al. ..... 194/200
7,963,382 B2 6/2011 Wendell et al. ..... 194/302
7,980,378 B2 7/2011 Jones et al. ..... 194/217
8,023,715 B2 9/2011 Jones et al. ..... 382/135
8,042,732 B2 10/2011 Blake et al. ..... 235/375
8,229,821 B2 7/2012 Mennie et al. ..... 232/16
8,393,455 B2 3/2013 Blake et al. ..... 194/350
8,443,958 B2 5/2013 Jones et al. ..... 194/215
RE44,252 E 6/2013 Jones et al. ..... 194/217
8,523,641 B2 9/2013 Kuykendall et al. ..... 194/217
8,545,295 B2 10/2013 Blake et al. ..... 453/4
8,602,200 B2 12/2013 Blake ..... 194/216
8,607,957 B2 12/2013 Blake et al. ..... 194/344
8,616,359 B2 12/2013 Bochonok et al. ..... 194/202
RE44,689 E 1/2014 Wendell et al. ..... 194/302
8,684,159 B2 4/2014 Blake ..... 194/216
8,684,160 B2 4/2014 Hallowell et al. ..... 194/344
8,701,860 B1 4/2014 Blake et al. ..... 194/350
8,950,566 B2 2/2015 Hallowell et al. ..... 194/206
8,959,029 B2 2/2015 Jones et al. ..... 705/18
9,092,924 B1 7/2015 Rasmussen et al.
2001/0034203 A1 10/2001 Geib et al. ..... 453/3
2001/0048025 A1 12/2001 Shinn ..... 235/382
2002/0000543 A1 * 1/2002 Arthur ..... E01F 15/0492 256/13.1
2002/0065033 A1 5/2002 Geib et al. ..... 453/3
2002/0069104 A1 6/2002 Beach et al. ..... 705/14
2002/0074209 A1 6/2002 Karlsson ..... 194/330
2002/0085745 A1 7/2002 Jones et al. ..... 382/135
2002/0095587 A1 7/2002 Doyle et al. ..... 713/186
2002/0107738 A1 8/2002 Beach et al. ..... 705/14
2002/0116887 A1 * 8/2002 Niday ..... E04C 5/161 52/318
2002/0126885 A1 9/2002 Mennie et al. ..... 382/135
2002/0130011 A1 * 9/2002 Casanova ..... G07D 3/06 194/344
2002/0147588 A1 10/2002 Davis et al. ..... 704/246
2002/0151267 A1 10/2002 Kuhlin et al. ..... 453/3
2002/0174348 A1 11/2002 Ting ..... 713/186
2002/0179401 A1 12/2002 Knox et al. ..... 194/217
2003/0004878 A1 1/2003 Akutsu et al. ..... 705/43
2003/0013403 A1 1/2003 Blake et al. ..... 453/60
2003/0042110 A1 3/2003 Wilfong ..... 194/302
2003/0081824 A1 5/2003 Mennie et al. ..... 382/135
2003/0127299 A1 7/2003 Jones et al. ..... 194/217
2003/0168309 A1 9/2003 Geib et al. ..... 194/302
2003/0168310 A1 9/2003 Strauts et al. ..... 194/302
2003/0182217 A1 9/2003 Chiles ..... 705/35

(56) References Cited

U.S. PATENT DOCUMENTS

| | | | | |
|---|---|---|---|---|
| 2003/0190882 | A1 | 10/2003 | Blake et al. | 453/63 |
| 2003/0230464 | A1 | 12/2003 | Deaville et al. | 194/302 |
| 2003/0234153 | A1 | 12/2003 | Blake et al. | 194/347 |
| 2004/0021898 | A1 | 2/2004 | Ashizaki | 358/1.15 |
| 2004/0055902 | A1 | 3/2004 | Peklo | 206/0.815 |
| 2004/0092222 | A1* | 5/2004 | Kowalczyk | G07D 9/00 453/12 |
| 2004/0153406 | A1 | 8/2004 | Alarcon-Luther et al. | 705/41 |
| 2004/0153421 | A1 | 8/2004 | Robinson | 705/75 |
| 2004/0154899 | A1 | 8/2004 | Peklo et al. | 193/33 |
| 2004/0173432 | A1 | 9/2004 | Jones | 194/216 |
| 2004/0188221 | A1 | 9/2004 | Carter | 194/215 |
| 2004/0195302 | A1 | 10/2004 | Washington et al. | 232/15 |
| 2004/0199924 | A1 | 10/2004 | Ganesh et al. | 719/313 |
| 2004/0200691 | A1 | 10/2004 | Geib et al. | 194/302 |
| 2004/0238319 | A1 | 12/2004 | Hand et al. | 194/207 |
| 2004/0238614 | A1 | 12/2004 | Yoshioka et al. | 232/7 |
| 2004/0256197 | A1 | 12/2004 | Blake et al. | 194/350 |
| 2004/0259490 | A1* | 12/2004 | Hino | G07D 3/00 453/3 |
| 2005/0006197 | A1 | 1/2005 | Wendell et al. | 194/302 |
| 2005/0035140 | A1 | 2/2005 | Carter | 221/195 |
| 2005/0040007 | A1 | 2/2005 | Geib et al. | 194/302 |
| 2005/0040225 | A1 | 2/2005 | Csulits et al. | 235/379 |
| 2005/0045450 | A1 | 3/2005 | Geib et al. | 194/318 |
| 2005/0067305 | A1 | 3/2005 | Bochonok et al. | 206/8 |
| 2005/0077142 | A1 | 4/2005 | Tam et al. | 194/217 |
| 2005/0086140 | A1 | 4/2005 | Ireland et al. | 705/35 |
| 2005/0087425 | A1 | 4/2005 | Peklo | 194/350 |
| 2005/0096986 | A1 | 5/2005 | Taylor et al. | 705/16 |
| 2005/0098625 | A1 | 5/2005 | Walker et al. | 235/381 |
| 2005/0108165 | A1 | 5/2005 | Jones et al. | 705/43 |
| 2005/0109836 | A1 | 5/2005 | Ben-Aissa | 235/380 |
| 2005/0121507 | A1 | 6/2005 | Brown et al. | 235/379 |
| 2005/0124407 | A1 | 6/2005 | Rowe | 463/25 |
| 2005/0150740 | A1 | 7/2005 | Finkenzeller et al. | 194/207 |
| 2005/0156318 | A1 | 7/2005 | Douglas | 257/761 |
| 2005/0205654 | A1 | 9/2005 | Carter | 235/7 R |
| 2005/0205655 | A1 | 9/2005 | Carter | 235/7 R |
| 2005/0228717 | A1 | 10/2005 | Gusler et al. | 705/14 |
| 2005/0233684 | A1* | 10/2005 | Abe | G07D 9/008 453/49 |
| 2005/0256792 | A1 | 11/2005 | Shimizu et al. | 705/35 |
| 2006/0037835 | A1 | 2/2006 | Doran et al. | 194/302 |
| 2006/0054455 | A1 | 3/2006 | Kuykendall et al. | 194/217 |
| 2006/0054457 | A1 | 3/2006 | Long et al. | 194/347 |
| 2006/0060363 | A2 | 3/2006 | Carter | 172/111 |
| 2006/0064379 | A1 | 3/2006 | Doran et al. | 705/42 |
| 2006/0065717 | A1 | 3/2006 | Hurwitz et al. | 235/381 |
| 2006/0069654 | A1 | 3/2006 | Beach et al. | 705/65 |
| 2006/0146839 | A1 | 7/2006 | Hurwitz et al. | 370/401 |
| 2006/0148394 | A1* | 7/2006 | Blake | G07D 3/128 453/12 |
| 2006/0149415 | A1 | 7/2006 | Richards | 700/236 |
| 2006/0151285 | A1 | 7/2006 | String | 194/350 |
| 2006/0154589 | A1 | 7/2006 | String | 453/11 |
| 2006/0175176 | A1 | 8/2006 | Blake | 194/216 |
| 2006/0182330 | A1 | 8/2006 | Chiles | 382/135 |
| 2006/0196754 | A1 | 9/2006 | Bochonok et al. | 194/347 |
| 2006/0205481 | A1 | 9/2006 | Dominelli | 463/25 |
| 2006/0207856 | A1 | 9/2006 | Dean et al. | 194/302 |
| 2006/0219519 | A1 | 10/2006 | Molbak et al. | 194/346 |
| 2006/0253332 | A1 | 11/2006 | Dobbins | 705/21 |
| 2006/0283685 | A1 | 12/2006 | Cousin | 194/217 |
| 2007/0051582 | A1 | 3/2007 | Bochonok et al. | 194/202 |
| 2007/0071302 | A1 | 3/2007 | Jones et al. | 382/135 |
| 2007/0108015 | A1 | 5/2007 | Bochonok et al. | 194/350 |
| 2007/0119681 | A1 | 5/2007 | Blake et al. | 194/215 |
| 2007/0181676 | A1 | 8/2007 | Mateen et al. | 235/381 |
| 2007/0187494 | A1 | 8/2007 | Hanna | 235/383 |
| 2007/0221470 | A1 | 9/2007 | Mennie et al. | 194/216 |
| 2007/0251800 | A1 | 11/2007 | Castleberry | 194/219 |
| 2007/0269097 | A1 | 11/2007 | Chiles et al. | 382/135 |
| 2007/0270997 | A1 | 11/2007 | Brumfield et al. | 700/214 |
| 2008/0033829 | A1 | 2/2008 | Mennie et al. | 705/16 |
| 2008/0044077 | A1 | 2/2008 | Mennie et al. | 382/135 |
| 2008/0135608 | A1 | 6/2008 | Ireland et al. | 232/1 D |
| 2008/0220707 | A1 | 9/2008 | Jones et al. | 453/2 |
| 2008/0223930 | A1 | 9/2008 | Rolland et al. | 235/385 |
| 2009/0018959 | A1 | 1/2009 | Doran et al. | 705/44 |
| 2009/0236200 | A1 | 9/2009 | Hallowell et al. | 194/215 |
| 2009/0236201 | A1 | 9/2009 | Blake et al. | 194/215 |
| 2009/0239459 | A1 | 9/2009 | Watts et al. | 453/18 |
| 2009/0242626 | A1 | 10/2009 | Jones et al. | 235/379 |
| 2009/0320106 | A1 | 12/2009 | Jones et al. | 726/5 |
| 2010/0038419 | A1 | 2/2010 | Blake et al. | 235/379 |
| 2010/0041289 | A1* | 2/2010 | Spencer | B63B 22/00 441/1 |
| 2010/0065623 | A1 | 3/2010 | Sauter | 232/1 D |
| 2010/0198726 | A1 | 8/2010 | Doran et al. | 705/41 |
| 2010/0234985 | A1 | 9/2010 | Shuren et al. | 700/223 |
| 2010/0261421 | A1 | 10/2010 | Wendell et al. | 453/4 |
| 2010/0276485 | A1 | 11/2010 | Jones et al. | 235/379 |
| 2010/0327005 | A1 | 12/2010 | Martin et al. | 221/98 |
| 2011/0098845 | A1 | 4/2011 | Mennie et al. | 700/223 |
| 2011/0099105 | A1 | 4/2011 | Mennie et al. | 705/41 |
| 2011/0189932 | A1* | 8/2011 | Adams | G07D 3/06 453/3 |
| 2011/0259961 | A1 | 10/2011 | Fold et al. | 235/385 |
| 2011/0270695 | A1 | 11/2011 | Jones et al. | 705/43 |
| 2012/0067950 | A1 | 3/2012 | Blake | 235/381 |
| 2012/0156976 | A1 | 6/2012 | Blake et al. | 453/4 |
| 2013/0178139 | A1 | 7/2013 | Hallowell et al. | 453/15 |
| 2013/0199890 | A1 | 8/2013 | Blake | 194/216 |
| 2013/0205723 | A1 | 8/2013 | Blake et al. | 53/473 |
| 2015/0302678 | A1 | 10/2015 | Blake et al. | |

FOREIGN PATENT DOCUMENTS

| | | | | |
|---|---|---|---|---|
| CA | 2143943 | C | 3/2003 | G07D 3/16 |
| DE | 06 60 354 | | 5/1938 | G07F 17/26 |
| DE | 30 21 327 | A1 | 12/1981 | G07D 3/06 |
| EP | 0 351 217 | A2 | 1/1990 | G07D 9/04 |
| EP | 0 667 973 | B1 | 1/1997 | G07D 3/14 |
| EP | 0 926 634 | A2 | 6/1999 | G07D 3/14 |
| EP | 1 104 920 | A1 | 6/2001 | G07D 5/08 |
| EP | 1 209 639 | A2 | 5/2002 | G07F 19/00 |
| EP | 1 528 513 | A1 | 5/2005 | G07F 7/08 |
| EP | 2468656 | A1 * | 6/2012 | B65D 43/02 |
| FR | 2042254 | | 2/1971 | G07B 11/00 |
| GB | 2035642 | A | 6/1980 | G07F 7/10 |
| GB | 2175427 | A | 11/1986 | G07F 17/42 |
| GB | 2198274 | A | 6/1988 | G07D 3/00 |
| GB | 2458387 | A | 9/2009 | G07D 11/00 |
| GB | 2468783 | A | 9/2010 | C07D 9/00 |
| JP | 49-058899 | | 6/1974 | |
| JP | 52-014495 | | 2/1977 | G07F 5/10 |
| JP | 52-071300 | A | 6/1977 | G07F 5/22 |
| JP | 56-040992 | A | 4/1981 | G07F 5/18 |
| JP | 57-117080 | A | 7/1982 | G07D 3/16 |
| JP | 59-079392 | A | 5/1984 | G07D 3/16 |
| JP | 60-016271 | U | 2/1985 | G07F 7/02 |
| JP | 62-134168 | U | 8/1987 | G07B 1/00 |
| JP | 62-182995 | A | 8/1987 | G07F 7/08 |
| JP | 62-221773 | A | 9/1987 | G06F 15/30 |
| JP | 62-166562 | U | 10/1987 | G07B 1/00 |
| JP | 64-035683 | A | 2/1989 | G07D 9/00 |
| JP | 64-042789 | A | 2/1989 | G07D 9/00 |
| JP | 64-067698 | A | 3/1989 | G07F 7/08 |
| JP | 01-118995 | A | 5/1989 | G07G 1/00 |
| JP | 01-307891 | A | 12/1989 | G07D 9/00 |
| JP | 02-050793 | A | 2/1990 | G07D 9/00 |
| JP | 02-252096 | A | 10/1990 | G07D 9/00 |
| JP | 03-012776 | A | 1/1991 | G06F 15/30 |
| JP | 03-063795 | A | 3/1991 | G07D 3/00 |
| JP | 03-092994 | A | 4/1991 | G07D 9/00 |
| JP | 03-156673 | A | 7/1991 | G06F 15/30 |
| JP | 04-085695 | A | 3/1992 | G07F 11/72 |
| JP | 04-175993 | A | 6/1992 | G07F 5/22 |
| JP | 05-046839 | A | 2/1993 | G07D 5/02 |
| JP | 05-217048 | A | 8/1993 | G07D 3/16 |
| JP | 05-274527 | A | 10/1993 | G07D 9/00 |
| JP | 06-035946 | A | 2/1994 | G06F 15/30 |
| JP | 06-103285 | A | 4/1994 | G06F 15/21 |

(56) References Cited

FOREIGN PATENT DOCUMENTS

| | | | | |
|---|---|---|---|---|
| JP | 09-251566 | A | 9/1997 | G07F 7/08 |
| JP | 2002-117439 | A | 4/2002 | G07D 9/00 |
| JP | 2003-242287 | A | 8/2003 | G06F 17/60 |
| JP | 2004-213188 | A | 7/2004 | G06F 17/60 |
| SE | 44 244 | | 9/1988 | |
| WO | WO 85/00909 | A1 | 2/1985 | G07D 5/02 |
| WO | WO 91/06927 | A1 | 5/1991 | G07D 3/16 |
| WO | WO 91/08952 | A1 | 6/1991 | B65B 11/04 |
| WO | WO 91/12594 | A1 | 8/1991 | G07D 3/16 |
| WO | WO 91/18371 | A1 | 11/1991 | G07D 3/16 |
| WO | WO 92/08212 | A1 | 5/1992 | G07D 3/16 |
| WO | WO 92/20043 | A1 | 11/1992 | G07D 3/00 |
| WO | WO 92/20044 | A1 | 11/1992 | G07D 3/16 |
| WO | WO 92/22044 | A1 | 12/1992 | G07D 3/00 |
| WO | WO 93/00660 | A1 | 1/1993 | G07D 3/00 |
| WO | WO 93/09621 | A1 | 5/1993 | H04L 9/32 |
| WO | WO 94/06101 | A1 | 3/1994 | G07D 3/16 |
| WO | WO 94/08319 | A1 | 4/1994 | G07D 3/16 |
| WO | WO 94/23397 | A1 | 10/1994 | G07D 3/00 |
| WO | WO 95/02226 | A1 | 1/1995 | G07D 3/00 |
| WO | WO 95/04978 | A1 | 2/1995 | G07D 3/06 |
| WO | WO 95/06920 | A1 | 3/1995 | G07D 3/16 |
| WO | WO 95/09406 | A1 | 4/1995 | G07D 3/16 |
| WO | WO 95/13596 | A1 | 5/1995 | G07D 3/14 |
| WO | WO 95/19017 | A1 | 7/1995 | G07D 1/00 |
| WO | WO 95/23387 | A1 | 8/1995 | G07D 3/16 |
| WO | WO 95/30215 | A1 | 11/1995 | G07F 17/42 |
| WO | WO 96/07163 | A1 | 3/1996 | G07D 3/06 |
| WO | WO 96/07990 | A1 | 3/1996 | G07D 3/16 |
| WO | WO 96/12253 | A1 | 4/1996 | G07D 3/00 |
| WO | WO 96/27525 | A1 | 9/1996 | B65B 11/02 |
| WO | WO 96/27859 | A1 | 9/1996 | G07D 5/08 |
| WO | WO 97/22919 | A1 | 6/1997 | G06F 7/08 |
| WO | WO 97/25692 | A1 | 7/1997 | G07D 3/06 |
| WO | WO 98/24041 | A1 | 6/1998 | G06F 17/60 |
| WO | WO 98/24067 | A1 | 6/1998 | G07D 3/14 |
| WO | WO 98/48383 | A2 | 10/1998 | G07D 1/00 |
| WO | WO 98/48384 | A2 | 10/1998 | G07D 1/00 |
| WO | WO 98/48385 | A2 | 10/1998 | G07D 1/00 |
| WO | WO 98/51082 | A1 | 11/1998 | H04N 7/18 |
| WO | WO 98/59323 | A1 | 12/1998 | G07D 3/00 |
| WO | WO 99/00776 | A1 | 1/1999 | G07F 9/06 |
| WO | WO 99/06937 | A1 | 2/1999 | G06F 19/00 |
| WO | WO 99/16027 | A2 | 4/1999 | G07F 7/02 |
| WO | WO 99/33030 | A1 | 7/1999 | G07D 3/00 |
| WO | WO 99/41695 | A1 | 8/1999 | G06K 5/00 |
| WO | WO 99/48057 | A1 | 9/1999 | G07D 3/06 |
| WO | WO 99/48058 | A1 | 9/1999 | G07D 3/06 |
| WO | WO 00/48911 | A1 | 8/2000 | B65B 67/12 |
| WO | WO 00/65546 | A1 | 11/2000 | G07F 1/04 |
| WO | WO 01/63565 | A2 | 8/2001 | G07D 9/00 |
| WO | WO 02/071343 | A1 | 9/2002 | G07D 3/00 |
| WO | WO 03/052700 | A2 | 6/2003 | |
| WO | WO 03/079300 | A1 | 9/2003 | G07D 7/00 |
| WO | WO 03/085610 | A1 | 10/2003 | G07D 9/06 |
| WO | WO 03/107280 | A2 | 12/2003 | |
| WO | WO 04/044853 | A1 | 5/2004 | G07D 3/12 |
| WO | WO 04/109464 | A2 | 12/2004 | |
| WO | WO 05/041134 | A2 | 5/2005 | |
| WO | WO 05/088563 | A1 | 9/2005 | G07D 3/00 |
| WO | WO 06/086531 | A1 | 8/2006 | G07D 9/00 |
| WO | WO 07/035420 | A2 | 3/2007 | G06F 7/00 |
| WO | WO 07/120825 | A2 | 10/2007 | G06K 9/00 |

OTHER PUBLICATIONS

Amiel Industries: AI-1500 'Pulsar' High Performance Sorting and Bagging Machine, 13 pages (date unknown, but prior to Dec. 14, 2000).

AUI: Coinverter—"No More Lines . . . Self-Serve Cash-Out," by Cassius Elston, 1995 World Games Congress/Exposition Converter, 1 page (dated prior to 1995).

Brandt: 95 Series Coin Sorter Counter, 2 pages (1982).

Brandt: Model 817 Automated Coin and Currency Ordering System, 2 pages (1983).

Brandt: Model 920/925 Counter, 2 pages (date unknown, prior to Jul. 2011, possibly prior to Mar. 17, 1997).

Brandt: System 930 Electric Counter/Sorter, "Solving Problems, Pleasing Customer, Building Deposits," 1 page (date unknown, prior to Mar. 2, 2011, possibly prior to Mar. 17, 1997).

Brandt: Model 940-6 High Speed Sorter/Counter, 2 pages (date unknown, prior to Oct. 31, 1989).

Brandt: System 945 High-Speed Sorter, 2 pages (date unknown, prior to Mar. 2, 2011, possibly prior to Mar. 17, 1997).

Brandt: Model 952 Coin Sorter/Counter, 2 pages (date unknown, prior to Oct. 31, 1989).

Brandt: Model 954 Coin Sorter/Counter, 2 pages (date unknown, prior to Oct. 31, 1989).

Brandt: Model 957 Coin Sorter/Counter, 2 pages (date unknown, prior to Oct. 31, 1989).

Brandt: Model 958 Coin Sorter/Counter, 5 pages (CD1982).

Brandt: Model 960 High-Speed Coin Sorter & Counter, 2 pages (1984).

Brandt; Model 966 Microsort™ Coin Sorter and Counter, 4 pages, (1979).

Brandt: Model 970 Coin Sorter and Counter, 2 pages (1983).

Brandt: Model 1205 Coin Sorter Counter, 2 pages (1986).

Brandt: Model 1400 Coin Sorter Counter, 2 pages (date unknown, prior to Mar. 2, 2011, possibly prior to Mar. 17, 1997).

Brandt: Model 8904 Upfeed—"High Speed 4-Denomination Currency Dispenser," 2 pages (1989).

Brandt: Mach 7 High-Speed Coin Sorter/Counter, 2 pages (1992).

Case ICC Limited: CDS Automated Receipt Giving Cash Deposit System, 3 pages (date unknown, prior to Nov. 15, 2000).

Cash, Martin: Newspaper Article "Bank Blends New Technology With Service," Winnipeg Free Press, 1 page (Sep. 4, 1992).

Childers Corporation: Computerized Sorter/Counter, "To coin an old adage, time is money . . . ," 3 pages (1981).

CTcoin: CDS602 Cash Deposit System, 1 page (date unknown, prior to Jan. 15, 2001).

Cummins: Cash Information and Settlement Systems (Form 023-1408), 4 pages (date Dec. 1991).

Cummins: The Universal Solution To All Coin and Currency Processing Needs (Form 13C1218 3-83), 1 page (Mar. 1983).

Cummins: JetSort® High Speed Sorter/Counter Kits Kits I & J—Operating Instructions (Form 022-7123-00) 12 pages (1994).

Cummins: JetSort® Coin Sorter Counter/CA-130XL Coin Wrapper, Cummins Automated Money Systems (AMS) Case Study—Fifth-Third, "6,000 Coin Per Minute Counter/ Sorter Keeps pace With Fifth-Third Bank's Money Processing Needs," (Form 13C1180), 2 pages (Nov. 1981)

Cummins: JetSort®, "Venders Love JetSort," (13C1255), 1 page (Mar. 1987).

Cummins: JetSort® "High Speed CoinSorter & Counter for Payphone Applications," "CTOCS Ready" (Form 023-1365), 2 pages (Mar. 1989).

Cummins: JetSort® mailer, "One moving part simplicity," "Vendors—Are validators changing your coin and currency needs?" (Form 023-1297), 3 pages (Apr. 1987).

Cummins: JetSort® Series V High SpeedCoin Sorter/Counter, (Form 023-1383), 2 pages (Sep. 1990).

Cummins: JetSort® "Time for a Change, Be a smashing success!," (Form 023-1328), 1 page (Jun. 1988).

Cummins: JetSort® "Time for a Change—JetSort® vs. Brandt X," (Form 023-1330), 1 page (Jun. 1988).

Cummins: JetSort® "Time for a Change—No Coins Sorted After 3:00 or on Saturday," (Form 023-1327), 1 page (Aug. 1988).

Cummins: JetSort®, "What do all these Banks have in Common . . . ?", JetSort, CA-130XL coin wrapper, CA-118 coin wrapper, CA-4000 JetCount, (13C1203), 3 pages (Aug. 1982)

Cummins: JetSort® 700-01/CA-118 Coin Wrapper, Cummins Automated Money Systems (AMS) Case Study—University State Bank, "Cummins Money Processing System Boosts Teller Service at University State Bank," (Form 13C1192), 2 pages (Mar. 1982)

(56) References Cited

OTHER PUBLICATIONS

Cumrnins: JetSort® 700-01, Cummins Automated Money Systems (AMS) Case Study—First State Bank of Oregon, "JetSort® Gives Bank Coin Service Edge," (Form 13C1196), 2 pages (Apr. 1982).
Cummins: JetSort® 700-01 Coin Sorter/Counter, Operating Instructions, 14 pages (1982).
Cummins: JetSort® 701, Cummins Automated Money Systems (AMS) Case Study—Conveneo Vending, "High Speed Coin Sorter increases coin processing power at Conveneo Vending," (Form 13C1226), 2 pages (Jul. 1983).
Cummins: JetSort Models 701 and 750 , "State-of-the-art coin processing comes of age," 2 pages (Feb. 1984).
Cummins: JetSort® Model CA-750 Coin Processor (Item No. 50-152), 1 page (Jul. 1984).
Cummins: JetSort® Model CA-750 Coin Sorter/Counter and CA-4050 JetCount currency counter, "Money Processing Made Easy," (Form 13C1221) 2 pages (Jun. 1983).
Cummins: JetSort® Model 1701 with JetStops, Operating Instructions Manual (Form 022-1329-00), 16 pages (1984).
Cummins: JetSort® Model 1760 brochure, (Form 023-1262-00), 2 pages (Jul. 1985).
Cummins: JetSort® Models 1770 and 3000, Communication Package specification and operating instructions, 10 pages (uncertain, possibly Nov. 1985).
Cummins: JetSort® Model 1770, "JetSort® Speed and Accuracy, Now with Communications!", (Form 023-1272) 1 page (Oct. 1986).
Cummins: JetSort® 2000 861165 High Speed Coin Sorter/Counter (Form 023-1488), 2 pages (Oct. 2000).
Cummins: JetSort® 3000 Series High Speed Coin Sorter (Form 023-1468 Rev 1), 2 pages (Feb. 1995).
Cummins: JetSort® 3000 Series Options, "Talking JetSort 3000," (Form 023-1338-00), 1 page (between Feb. 1989-Feb. 1989).
Cummins: JetSort® 3000, "3,000 Coins per Minute!," (Form 023-1312), 1 page (date unknown, est. 1987).
Cummins: JetSort® 3200, Enhanced electronics for the JetSort® 3200 (Form 023-1350), 1 page (Apr. 1987).
De La Rue: CDS 500 Cash Deponier System, 6 pages (date unknown, p. 5 has date May 1994, p. 6 has date Dec. 1992) (German).
De La Rue: CDS 5700 and CDS 5800 Cash Deponier System (German) and translation, 7 pages (date unknown, prior to Aug. 13, 1996).
Diebold: Merchant MicroBranch, "Merchant MicroBranch Combines ATM After-Hour Depository Rolled-Coin Dispenser," Bank Technology News, 1 page (Nov. 1997).
Fa. GBS-Geldbearbeitungssysteme: GBS9401SB Technical Specification, 24 pages (date unknown, prior to Nov. 10, 2010).
Frisco Bay: Commercial Kiosk, "Provide self-service solutions for your business customers," 4 pages (date unknown, prior to Mar. 2, 2011, p. 4 has date 1996).
Glory: AMT Automated Merchant Teller, 4 pages (date unknown, prior to Jan. 15, 2001).
Glory: CRS-8000 Cash Redemption System, 2 pages (1996).
Hamilton: Hamilton's Express Banking Center, In Less Space Than a Branch Manager's Desk, 4 pages.(date unknown, prior to Jan. 15, 2001).
Intellectual Australia Pty. Ltd.: Microbank, "From down under: Microbank," "hand-held smart card terminal that combines smart card functions and telephone banking," 2 pages (Feb. 1996).
ISH Electronic: ISH 12005/500 Coin Counter (with translation), 4 pages (date unknown, prior to Aug. 1996).
ISH Electronic: ISH 12005/501 Self-Service Unit (with translation), 4 pages (date unknown, prior to Aug. 1996).
Namsys, Inc.: Namsys Express, Making currency management . . . more profitable, 2 pages (date unknown, prior to Jan. 15, 2001).
NGZ Geldzahlmaschinengesellschaft: NGZ 2100 Automated Coin Depository, 4 pages (date unknown, prior to Sep. 1996).
Perconta: Contomat Coin Settlement Machine for Customer Self Service, 2 pages (date unknown, prior to Apr. 2003).
Prema GmbH: Prema 405 (RE) Self Service Coin Deposit Facility, 2 pages (date unknown, prior to Apr. 2003).
Reis Eurosystems: CRS 6501/CRS 6510 Cash Receipt Systems for Self-Service Area, 3 pages (date unknown, prior to Aug. 13, 1996, maybe Feb. 1995).
Reis Eurosystems: CRS 6520/ CRS 6525 Standard-Class Coin Deposit Systems, 1 page (date unknown, to prior to Apr. 2003).
Reis Eurosystems: CS 3510 Disc-Sorter, 1 page (date unknown, prior to Apr. 2003).
Royal Bank: Hemeon, Jade, "Royal's Burlington drive-in bank provides customers 24-hour tellers," The Toronto Star, 1 page (Aug. 21, 1991).
Royal Bank: Leitch, Carolyn, "High-Tech Bank Counts Coins," The Globe and Mail, 2 pages (Sep. 19, 1991).
Royal Bank: Oxby, Murray, "Royal Bank Opens 'Super Branch,'" The Gazette Montreal, 2 pages (Sep. 14, 1991).
Royal Bank: SuperBranch, "Experience the Ultimate in Convenience Banking," 2 pages (Feb. 1992).
Scan Coin: International Report, 49 pages (Apr. 1987).
Scan Coin: Money Processing Systems, 8 pages (date unknown, prior to Apr. 2003).
Scan Coin: World, 2 pages (Feb. 1988).
Scan Coin: CDS Cash Deposit System, 6 pages (date unknown, prior to Apr. 2003) [SC 0369].
Scan Coin: CDS Coin Deposit System—Technical Referens Manual, 47 pages (1989).
Scan Coin: CDS 600 User's Manual, 14 pages (date unknown, prior to Apr. 2003).
Scan Coin: CDS 600 & CDS 640 Cash Deposit System—Technical Manual, 45 pages (date unknown, prior to Apr. 2003).
Scan Coin: CDS MK 1 Coin Deposit System—Technical Manual, 32 pages (1991).
Scan Coin: SC 102 Value Counter Technical Manual, 28 pages (date unknown, prior to Apr. 2003).
Pay by Touch: Secure ID News, "Piggly Wiggly Extends Biometric Payments Throughout the Southeast U.S.," 2 pages, (Dec. 14, 2005).
ESD, Inc: Smartrac Card System, "Coinless laundry makes quarters obsolete; Smartrac Card System really makes a change in laundry industry," Business Wire, 2 pages (Feb. 23, 1996).
Meece, Mickey: Article "Development Bank of Singapore Gets Cobranding Edge with Smart Cards," American Banker, New York, NY, vol. 159, Iss. 195, p. 37, 2 pages (Oct. 10, 1994).
Scan Coin: Coin Sachet System brochure, 4 pages (last page marked "© Scan Coin / Jun. 2007").

* cited by examiner

SYSTEMS, METHODS AND DEVICES FOR PROCESSING COINS UTILIZING A MULTI-MATERIAL COIN SORTING DISK

CLAIM OF PRIORITY AND CROSS-REFERENCE TO RELATED APPLICATION

This application claims the benefit of priority to U.S. Provisional Patent Application No. 62/078,245, which was filed on Nov. 11, 2014, and is incorporated herein by reference in its entirety.

TECHNICAL FIELD

The present disclosure relates generally to systems, methods, and devices for processing currency. More particularly, aspects of this disclosure relate to currency processing systems and coin processing machines with a disk-type coin sorter.

BACKGROUND

Some businesses, particularly banks, are regularly faced with large amounts of currency which must be organized, counted, authenticated and recorded. To hand count and record large amounts of currency of mixed denominations requires diligent care and effort, and demands significant manpower and time that might otherwise be available for more profitable and less tedious activity. To make counting of bills and coins less laborious, machines have been developed which automatically sort, by denomination, mixed assortments of currency, and transfer the processed currency into receptacles specific to the corresponding denominations. For example, coin processing machines for processing large quantities of coins from either the public at large or private institutions, such as banks, casinos, supermarkets, and cash-in-transit (CIT) companies, have the ability to receive bulk coins from customers and other users of the machine, count and sort the coins, and store the received coins in one or more coin receptacles, such as coin bins or coin bags. One type of currency processing machine is a redemption-type processing machine wherein, after the deposited coins and/or bank notes are counted, funds are returned to the user in a pre-selected manner, such as a payment ticket or voucher, a smartcard, a cash card, a gift card, and the like. Another variation is the deposit-type processing machine where funds which have been deposited by the user are credited to a personal account. Hybrid variations of these machines are also known and available.

A well-known device for processing coins is the disk-type coin sorter. In one exemplary configuration, the coin sorter, which is designed to process a batch of mixed coins by denomination, includes a rotatable disk that is driven by an electric motor. The lower surface of a stationary, annular sorting head (or "sort disk") is parallel to and spaced slightly from the upper surface of the rotatable disk. The mixed batch of coins is progressively deposited onto the top surface of the rotatable disk. As the disk is rotated, the coins deposited on the top surface thereof tend to slide outwardly due to centrifugal force. As the coins move outwardly, those coins which are lying flat on the top surface of the rotatable disk enter a gap between the disk and the sorting head. The lower surface of the sorting head is formed with an array of channels which guide coins of different denominations to different exit locations around the periphery of the disk. The exiting coins, having been sorted by denomination for separate storage, are counted by sensors located along the exit channel. A representative disk-type coin sorting mechanism is disclosed in U.S. Pat. No. 5,009,627, to James M. Rasmussen, which is incorporated herein by reference in its entirety and for all purposes.

It is oftentimes desirable in the sorting of coins to discriminate between valid coins and invalid coins. Use of the term "valid coin" can refer to genuine coins of the type to be sorted. Conversely, use of the term "invalid coin" can refer to items in the coin processing unit that are not one of the coins to be sorted. For example, it is common that foreign (or "stranger") coins and counterfeit coins enter a coin processing system for sorting domestic coin currency. So that such items are not sorted and counted as valid coins, it is helpful to detect and discard these "invalid coins" from the coin processing system. In another application wherein it is desired to process only U.S. quarters, nickels and dimes, all other U.S. coins, including dollar coins, half-dollar coins, pennies, etc., are considered "invalid." Additionally, coins from all other coins sets including Canadian coins and European coins, for example, would be considered "invalid" when processing U.S. coins. In another application it may be desirable to separate coins of one country (e.g., Canadian coins) from coins of another country (e.g., U.S. coins). Finally, any truly counterfeit coins (also referred to in the art as "slugs") are always considered "invalid" regardless of application.

SUMMARY

All-metal sort disks, the most common form factor for high-speed and high-volume disk-type coin sorting applications, typically require high-grade raw materials, precision machining, heat treating, polishing, water jet cutting, etc., and therefore are very expensive to manufacture and, thus, costly to purchase and replace. On top of initiatives to reduce the costs associated with manufacturing and purchasing a sort head, it is also desirable to customers and manufacturers to reduce downtime of a currency processing machine for repair or replacement of consumable parts, including worn and damaged sort heads. In addition to high-volume, high-speed applications, there are also applications, such as retail and recycling, that process significantly smaller volumes at lower speeds and therefore require a more cost effective sort head solution. It is therefore desirable, in at least some aspects of the disclosed concepts, to extend the operational life expectancy of sorting heads and to offer sort head configurations that are more economical.

Softer metal coins can gall when urged into contact with the harder material of all-metal sort disks. Galling, which is caused by sliding friction and adhesion between sliding surfaces of two engaging metal parts, results in material from the softer metal coins being stuck or even friction welded to the surface of the harder sorting disk. Conversely, high-speed, high-volume coin processing can cause premature wear on the recesses and contoured walls of the sort disk. Higher volumes of a single coin denomination can also cause uneven wear to corresponding sections of the sort disk. Coin galling and premature or uneven wear of the sort disk can result in mis-sorts/mis-match errors, errors in authentication, coin jams, sensor errors, coins exiting the disk prematurely, false rejects, and bag count inaccuracy. It is therefore desirable, in at least some aspects of the disclosed concepts, to offer sort head configurations that reduce coin galling, minimize premature or uneven wear of the sort disk, and/or offer a cost effective solution for remediating galling and wear.

Currency processing systems, coin processing machines, coin processing units, and methods of processing batches of coins are presented herein. For example, aspects of the present disclosure are directed to disk-type coin processing units and currency processing machines with disk-type coin processing units which utilize a multi-material sorting disk. In some embodiments, localized impact-resistant inserts fabricated from distinctively hard, abrasion and deformation resistant materials (e.g., tool steel) are provided at predetermined locations on the sort disk (e.g., high impact points in the exit channels, critical impact points in the gauging and queuing channels, etc.). In some embodiments, localized galling-resistant inserts fabricated from distinctively softer, friction reducing materials (e.g., low-friction polymer, carbon coated aluminum, etc.) are provided at predetermined locations on the sort disk (e.g., areas of high galling). In some embodiments, localized exit inserts fabricated from distinctively hard, wear resistant materials (e.g., tungsten carbide) are provided at predetermined locations on the sort disk (e.g., each exit channel is provided with an independent insert of distinct material). These localized inserts eliminate the need to replace the entire sort disk as a result of premature or uneven wear, allow for easy field change out, offer improved operational life of the sort disk, and provide increased uptimes of the machine, all of which help to reduce overhead, maintenance and warranty costs, and help to minimize service time and downtime.

In some embodiments, an all-plastic sort disk is provided, which helps to reduce the cost and galling issues associated with all-metal sort disks. For some embodiments, a plastic sort disk with a metal backing plate is provided. The metal backing provides the rigidity and alignment indexing needed for quick replacement of a worn or damaged plastic sort disk, which the plastic sort disk helps to reduce the cost and galling issues associated with all-metal sort disks. In some embodiments, a coin sort disk with a plastic sorting surface over-molded onto a metal backing plate is disclosed. An over-mold process is used to mold a plastic sort disk with a metal support ring to offer the rigidity needed to process coins. For some configurations, a plastic sort disk (with or without metal backing or over-mold) with localized inserts is provided. Inserts could be strategically located at high impact points, critical impact points, areas of high galling, and/or at the exit and queuing channels to improve the life of the sort disk. In some embodiments, a plastic molded sort disk with over-molded inserts is provided. The necessary mounting provisions and/or sensors can be molded directly into the sort disc. Optionally, inserts of varying materials can be utilized to create necessary friction surfaces and thereby provide localized friction requirements for varying coin control needs.

Aspects of the present disclosure are directed to a currency processing system with a housing, one or more coin receptacles, and a disk-type coin processing unit. The housing has a coin input area for receiving a batch of coins. One or more coin receptacles, which are stowed inside or adjacent the housing, are operatively coupled to the housing for receiving and storing processed coins. The disk-type coin processing unit is operatively coupled to the coin input area and the coin receptacle(s) to transfer coins therebetween. The coin processing unit includes a rotatable disk for imparting motion to a plurality of the coins received by the coin input area of the housing. A sorting head of a first material has a lower surface that is generally parallel to and at least partially spaced from the rotatable disk. The lower surface of the sorting head forms a plurality of shaped regions that guide the coins, under the motion imparted by the rotatable disk, to a plurality of exit channels configured to sort and discharge the coins through a plurality of exit stations to the coin receptacle(s). The sorting head also includes a plurality of localized inserts of a second material which is distinct from the first material of the sorting head. Each localized insert may have a distinct shape and can be readily removably attached at a distinct one of a plurality of predetermined locations on the sorting head.

A coin processing machine is also featured in accordance with aspects of this disclosure. The coin processing machine has a housing with a coin input area for receiving therethrough a batch of coins. Plural coin receptacles and a processor are stowed inside the housing. A disk-type coin processing unit is disposed at least partially inside the housing and is operatively coupled to the coin input area and the coin receptacles to transfer coins therebetween. The coin processing unit includes a rotatable disk for supporting on an upper surface thereof and imparting motion to a plurality of coins received from the coin input area. The coin processing unit also includes a stationary sorting disk with a lower surface that is generally parallel to and spaced slightly apart from the rotatable disk. The lower surface of the sorting disk forms a plurality of shaped regions that guide the coins, under the motion imparted by the rotatable disk, from a central region of the sorting disk to a plurality of circumferentially spaced exit channels. The exit channels sort and discharge the coins through a plurality of exit stations to the coin receptacles. The stationary sorting disk is fabricated from a first material with a first hardness. The sorting disk also includes a plurality of localized inserts fabricated from a second material of a second hardness which is distinct from the first material and the first hardness of the sorting disk, respectively. Optionally, the hardness of the material of the stationary sorting disk is approximately the same as the hardness of the material of one or more or all of the inserts. Each localized insert can have a distinct shape and can be readily removably attached at a distinct one of a plurality of predetermined locations on the sorting disk.

According to other aspects of the present disclosure, a disk-type coin processing unit for a currency processing apparatus is presented. The currency processing apparatus includes a housing with an input area for receiving coins, and one or more coin receptacles for stowing processed coins. The disk-type coin processing unit includes a rotatable disk configured to impart motion to a plurality of the coins. The disk-type coin processing unit also includes a sorting head of a first material with a first hardness having a lower surface that is generally parallel to and at least partially spaced from the rotatable disk. The lower surface of the sorting head forms a plurality of shaped regions configured to guide the coins, under the motion imparted by the rotatable disk, to a plurality of exit channels configured to sort and discharge the coins through a plurality of exit stations to the one or more coin receptacles. The disk-type coin processing unit further comprises a plurality of localized inserts of a second material with a second hardness which is distinct from the first material and the first hardness of the sorting head, respectively. Each of the localized inserts can have a distinct shape and can be readily removably attached at a distinct one of a plurality of predetermined locations on the sorting head.

Aspects of the present disclosure are directed to a currency processing system with a housing, one or more coin receptacles, and a disk-type coin processing unit. The housing has a coin input area for receiving a batch of coins. One or more coin receptacles, which are stowed inside or adjacent the housing, are operatively coupled to the housing for receiving and storing processed coins. The disk-type coin processing unit is operatively coupled to the coin input area and the coin receptacle(s) to transfer coins therebetween. The coin processing unit includes a rotatable disk and a multi-part sorting head assembly. The rotatable disk is configured to impart motion to some or all of the coins received by the coin input area of the housing. The multi-part sorting head assembly includes an annular sorting disk that is fabricated from a first rigid material and attached to an annular backing plate that is fabricated from a second rigid material which is distinct from the first rigid material. The annular sorting disk has a lower surface which is generally parallel to and at least partially spaced from the rotatable disk. The lower surface forms numerous shaped regions configured to guide the coins, under the motion imparted by the rotatable disk, to a plurality of exit channels configured to sort and discharge the coins through a plurality of exit stations to the one or more coin receptacles.

Other aspects of the present disclosure are directed to a coin processing machine for sorting, authenticating, denominating, counting or otherwise processing batches of coins. The coin processing machine includes a housing with an input area for receiving therethrough a batch of coins. A plurality of coin receptacles and a processor are stored inside the housing. The coin processing machine also includes a disk-type coin processing unit that is disposed at least partially inside the housing and operatively coupled to the coin input area and the coin receptacles to transfer coins therebetween. The coin processing unit includes a rotatable disk and a bipartite sorting head. The rotatable disk is configured to support on an upper surface thereof and impart motion to a plurality of coins received from the coin input area. The bipartite sorting head assembly includes a single-piece annular sorting disk that is fabricated from a rigid or substantially rigid first (polymeric) material that is overmolded onto a single-piece annular backing plate that is fabricated from a rigid second (metallic) material. The annular sorting disk having a lower surface that is generally parallel to and at least partially spaced from the rotatable disk. The lower surface forms a plurality of shaped regions configured to guide the coins, under the motion imparted by the rotatable disk, to a plurality of exit channels configured to sort and discharge the coins through a plurality of exit stations to the one or more coin receptacles.

Also presented in this disclosure are disk-type coin processing units for a currency processing apparatus. The currency processing apparatus includes a housing with an input area for receiving coins, and one or more coin receptacles for stowing processed coins. The disk-type coin processing unit comprises a rotatable disk for imparting motion to the coins, and a multi-part sorting head assembly with an annular sorting disk of a first rigid material attached to an annular backing plate of a second distinct rigid material. The annular sorting disk has a lower surface that is generally parallel to and at least partially spaced from the rotatable disk. The lower surface forms a plurality of shaped regions configured to guide the coins, under the motion imparted by the rotatable disk, to a plurality of exit channels configured to sort and discharge the coins through a plurality of exit stations to the one or more coin receptacles.

Methods of making and methods of using any of the foregoing processing systems, processing machines, processing units, etc., are also within the scope and spirit of this disclosure.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of the exemplary embodiments and modes for carrying out the present invention when taken in connection with the accompanying drawings and appended claims.

Figure 1:
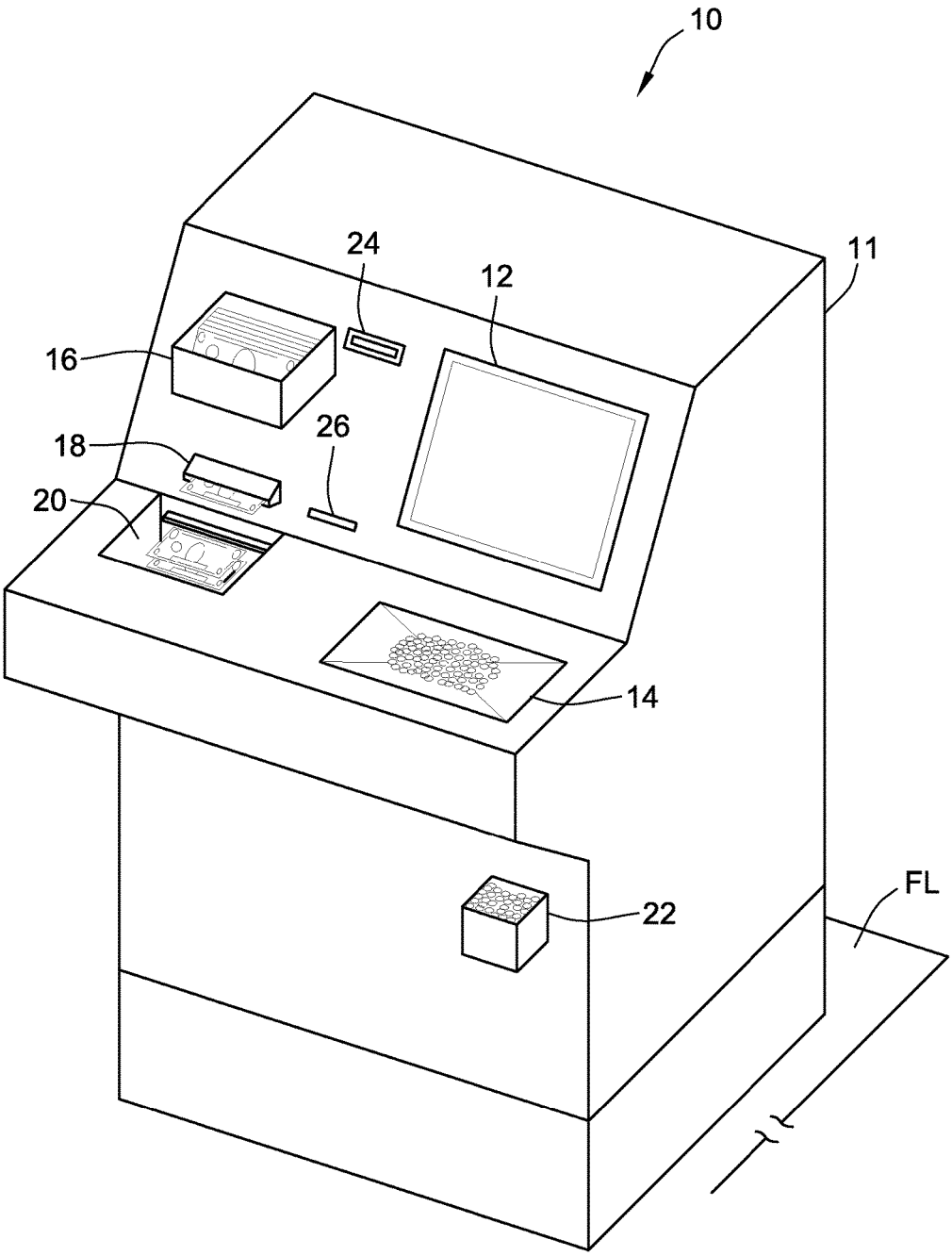
FIG. 1 is a front perspective-view illustration of an example of a currency processing system in accordance with aspects of the present disclosure.

The present disclosure is susceptible to various modifications and alternative forms, and some representative embodiments have been shown by way of example in the drawings and will be described in detail herein. It should be understood, however, that the inventive aspects of this disclosure are not limited to the particular forms illustrated in the drawings. Rather, the disclosure is to cover all modifications, equivalents, combinations and subcombinations, and alternatives falling within the spirit and scope of the invention as defined by the appended claims.

DETAILED DESCRIPTION OF THE ILLUSTRATED EMBODIMENTS

This disclosure is susceptible of embodiment in many different forms. There are shown in the drawings, and will herein be described in detail, representative embodiments with the understanding that the present disclosure is to be considered as an exemplification of the principles of the invention and is not intended to limit the broad aspects of the invention to the illustrated embodiments. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the word "all" means "any and all"; the word "any" means "any and all"; and the words "including" or "comprising" or "having" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring now to the drawings, wherein like reference numerals refer to like components throughout the several views, FIG. 1 illustrates an example of a currency processing system, designated generally as 10, in accordance with aspects of the present disclosure. Many of the disclosed concepts are discussed with reference to the representative currency processing systems depicted in the drawings. However, the novel aspects and features of the present disclosure are not per se limited to the particular arrangements and components presented in the drawings. For example, many of the features and aspects presented herein can be applied to other currency processing systems without departing from the intended scope and spirit of the present disclosure. Examples of currency processing systems into which the disclosed concepts can be incorporated are the JetSort™ family of coin sorting machines available from Cummins-Allison Corp. In addition, although differing in appearance, each of the coin processing systems and devices and functional componentry depicted and discussed herein can take on any of the various forms, optional configurations, and functional alternatives described above and below with respect to the other disclosed embodiments, and thus can include any of the corresponding options and features, unless explicitly disclaimed or otherwise logically prohibited. It should also be understood that the drawings are not necessarily to scale and are provided purely for descriptive purposes; thus, the individual and relative dimensions and orientations presented in the drawings are not to be considered limiting.

The currency processing system 10 is a hybrid redemption-type and deposit-type currency processing machine with which funds may be deposited into and returned from the machine, in similar or different forms, in whole or in part, and/or funds may be credited to and withdrawn from a personal account. The currency processing machine 10 illustrated in FIG. 1 includes a housing 11 that may house various input devices, output devices, and input/output devices. By way of non-limiting example, the currency processing machine 10 includes a display device 12 that may provide various input and output functions, such as displaying information and instructions to a user and receiving selections, requests, and other forms of inputs from a user. The display device 12 is, in various embodiments, a cathode ray tube (CRT), a high-resolution liquid crystal display (LCD), a plasma display, a light emitting diode (LED) display, a DLP projection display, an electroluminescent (EL) panel, or any other type of display suitable for use in the currency processing machine 10. A touch screen, which has one or more user-selectable soft touch keys, may be mounted over the display device 12. While a display device 12 with a touchscreen may be a preferred means for a user to enter data, the currency processing machine 10 may include other known input devices, such as a keyboard, mouse, joystick, microphone, etc.

The currency processing machine 10 includes a coin input area 14, such as a bin or tray, which receives batches of coins from a user. Each coin batch may be of a single denomination, a mixed denomination, a local currency, or a foreign currency, or any combination thereof. Additionally, a bank note input area 16, which may be in the nature of a retractable pocket or basket, is also offered by the currency processing machine 10. The bank note input area 16, which is illustrated in its open position in FIG. 1, can be retracted by the currency processing machine 10 once the bulk currency has been placed therein by the user. In addition to banknotes, or as a possible alternative, the bank note receptacle 16 of the currency processing machine 10 can also be operable to accommodate casino scrip, paper tokens, bar coded tickets, or other known forms of value. These input devices—i.e., the currency input areas 14 and 16, allow the user of the currency processing machine 10 to input his or her funds, which can ultimately be converted to some other sort of fund source that is available to the user. Optionally or alternatively, the currency processing machine 10 can operate to count, authenticate, valuate, and/or package funds deposited by a user.

In addition to the above-noted output devices, the currency processing machine 10 may include various output devices, such as a bank note dispensing receptacle 20 and a coin dispensing receptacle 22 for dispensing to the user a desired amount of funds in bank notes, coins, or a combination thereof. An optional bank note return slot 18 may also be included with the currency processing machine 10 to return notes to the user, such as those which are deemed to be counterfeit or otherwise cannot be authenticated or processed. Coins which cannot be authenticated or otherwise processed may be returned to the user via the coin dispensing receptacle 22. The currency processing machine 10 further includes a paper dispensing slot 26, which can be operable for providing a user with a receipt of the transaction that was performed.

In one representative transaction, the currency processing machine 10 receives funds from a user via the coin input area 14 and/or the bank note input area 16 and, after these deposited funds have been authenticated and counted, the currency processing machine 10 returns to the user an amount equal to the deposited funds but in a different variation of bank notes and coins. Optionally, the user may be assessed one or more fees for the transaction (e.g., service fees, transaction fees, etc.). For example, the user of the currency processing machine 10 may input $102.99 in various small bank notes and pennies and in turn receive a $100 bank note, two $1 bank notes, three quarters, two dimes, and four pennies. As another option or alternative, the currency processing machine 10 may simply output a voucher or a receipt of the transaction through the paper dispensing slot 26 which the user can then redeem for funds by an attendant of the currency processing machine 10. Yet another option or alternative would be for the currency processing machine 10 to credit some or all of the funds to a personal account, such as a bank account or store account. As yet another option, the currency processing machine 10 may credit some or all of the funds to a smartcard, gift card, cash card, virtual currency, etc.

The currency processing machine 10 may also include a media reader slot 24 into which the user inserts a portable medium or form of identification, such as a driver's license, credit card, or bank card, so that the currency processing machine 10 can, for example, identify the user and/or an account associated with the user. The media reader 24 may take on various forms, such as a ticket reader, card reader, bar code scanner, wireless transceiver (e.g., RFID, Bluetooth, etc.), or computer-readable-storage-medium interface. The display device 12 with a touchscreen typically provides the user with a menu of options which prompts the user to carry out a series of actions for identifying the user by displaying certain commands and requesting that the user press touch keys on the touch screen (e.g. a user PIN). The media reader device 24 of the illustrated example is configured to read from and write to one or more types of media. This media may include various types of memory storage technology such as magnetic storage, solid state memory devices, and optical devices. It should be understood that numerous other peripheral devices and other elements exist and are readily utilizable in any number of combinations to create various forms of a currency processing machine in accord with the present concepts.

Figure 2:
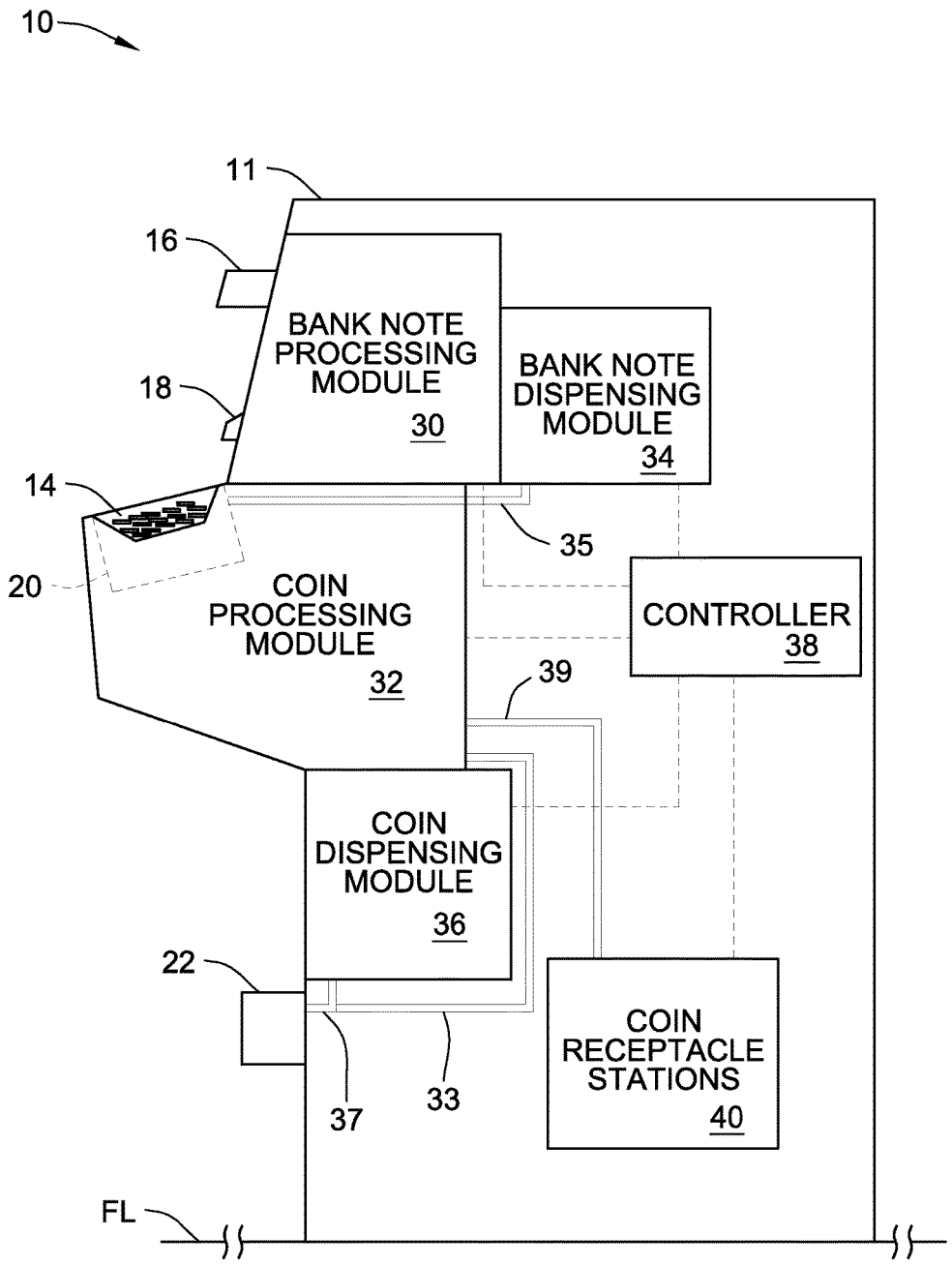
FIG. 2 is a schematic side-view illustration of the representative currency processing machine of FIG. 1.

FIG. 2 is a schematic illustration of the currency processing machine 10 showing various modules which may be provided in accord with the disclosed concepts. A bank note processing module 30, for example, receives bank notes from the bank note input area 16 for processing. In accord with a representative configuration, the inward movement of a retractable bank note input area 16 positions a stack of bills at a feed station of the bank note scanning and counting device which automatically feeds, counts, scans, authenticates, and/or sorts the bank notes, one at a time, at a high rate of speed (e.g., at least approximately 350 bills per minute). In place of, or in addition to the bank note input area 16, the currency processing machine 10 may include a single bank note receptacle for receiving and processing one bank note at a time. The bank notes that are recognized and/or deemed authentic by the bank note processing module 30 are delivered to a currency canister, cassette or other known storage container. When a bank note cannot be recognized by the bank note processing module 30, it can be returned to the customer through the bank note return slot 18. Exemplary machines which scan, sort, count, and authenticate bills as may be required by the bank note processing module 30 are described in U.S. Pat. Nos. 5,295,196, 5,970,497, 5,875,259, which are incorporated herein by reference in their respective entireties and for all purposes.

The representative currency processing machine 10 shown in FIG. 2 also includes a coin processing module 32. The coin processing module 32 may be operable to sort, count, valuate and/or authenticate coins which are deposited in the coin input receptacle 14, which is operatively connected to the coin processing module 32. The coins can be sorted by the coin processing module 32 in a variety of ways, but one known method is sorting based on the diameters of the coins. When a coin cannot be authenticated or counted by the coin processing module 32, it can be directed back to the user through a coin reject tube 33 which leads to the coin dispensing receptacle 22. Thus, a user who has entered such a non-authenticated coin can retrieve the coin by accessing the coin dispensing receptacle 22. Examples of coin sorting and authenticating devices which can perform the function of the coin processing module 32 are disclosed in U.S. Pat. Nos. 5,299,977, 5,453,047, 5,507,379, 5,542,880, 5,865,673, 5,997,395, which are incorporated herein by reference in their respective entireties and for all purposes.

The currency processing machine 10 further includes a bank note dispensing module 34 which is connected via a transport mechanism 35 to the user-accessible bank note dispensing receptacle 20. The bank note dispensing module 34 typically dispenses loose bills in response to a request of the user for such bank notes. Also, the bank note dispensing module 34 may be configured to dispense strapped notes into the bank note dispensing receptacle 20 if that is desired. In one embodiment of the present disclosure, the user may select the denominations of the loose/strapped bills dispensed into the bank note dispensing receptacle 20.

The currency processing machine 10 also includes a coin dispensing module 36 which dispenses loose coins to the user via the coin dispensing receptacle 22. The coin dispensing module 36 is connected to the coin dispensing receptacle 22, for example, via a coin tube 37. With this configuration, a user of the currency processing machine 10 has the ability to select the desired coin denominations that he or she will receive during a transaction, for example, in response to user inputs received by one or more of the available input devices. Also, the coin dispensing module 36 may be configured to dispense packaged (e.g., sachet or rolled) coins into the coin dispensing receptacle 22 if that is desired. The coins which have been sorted into their respective denominations by the coin processing module 32 are discharged into one or more coin chutes or tubes 39 which direct coins to a coin receptacle station(s) 40. In at least some aspects, a plurality of tubes 39 are provided and advantageously are positioned to direct coins of specified denominations to designated coin receptacles. The currency processing machine 10 may include more or fewer than the modules illustrated in FIG. 2, such as a coin packaging module or a note packaging module.

The currency processing machine 10 includes a controller 38 which is coupled to each module within the currency processing machine 10, and optionally to an external system, and controls the interaction between each module. For example, the controller 38 may review the input totals from the funds processing modules 30 and 32 and direct an appropriate funds output via the funds dispensing modules 34 and 36. The controller 38 also directs the operation of the coin receptacle station 40 as described below. While not shown, the controller 38 is also coupled to the other peripheral components of the currency processing machine 10, such as a media reader associated with the media reader slot 24 and also to a printer at the receipt dispenser 26, if these devices are present on the coin processing mechanism 10. The controller 38 may be in the nature of a central processing unit (CPU) connected to a memory device. The controller 38 may include any suitable processor, processors and/or microprocessors, including master processors, slave processors, and secondary or parallel processors. The controller 38 may comprise any suitable combination of hardware, software, or firmware disposed inside and/or outside of the housing 11.

Figure 3:
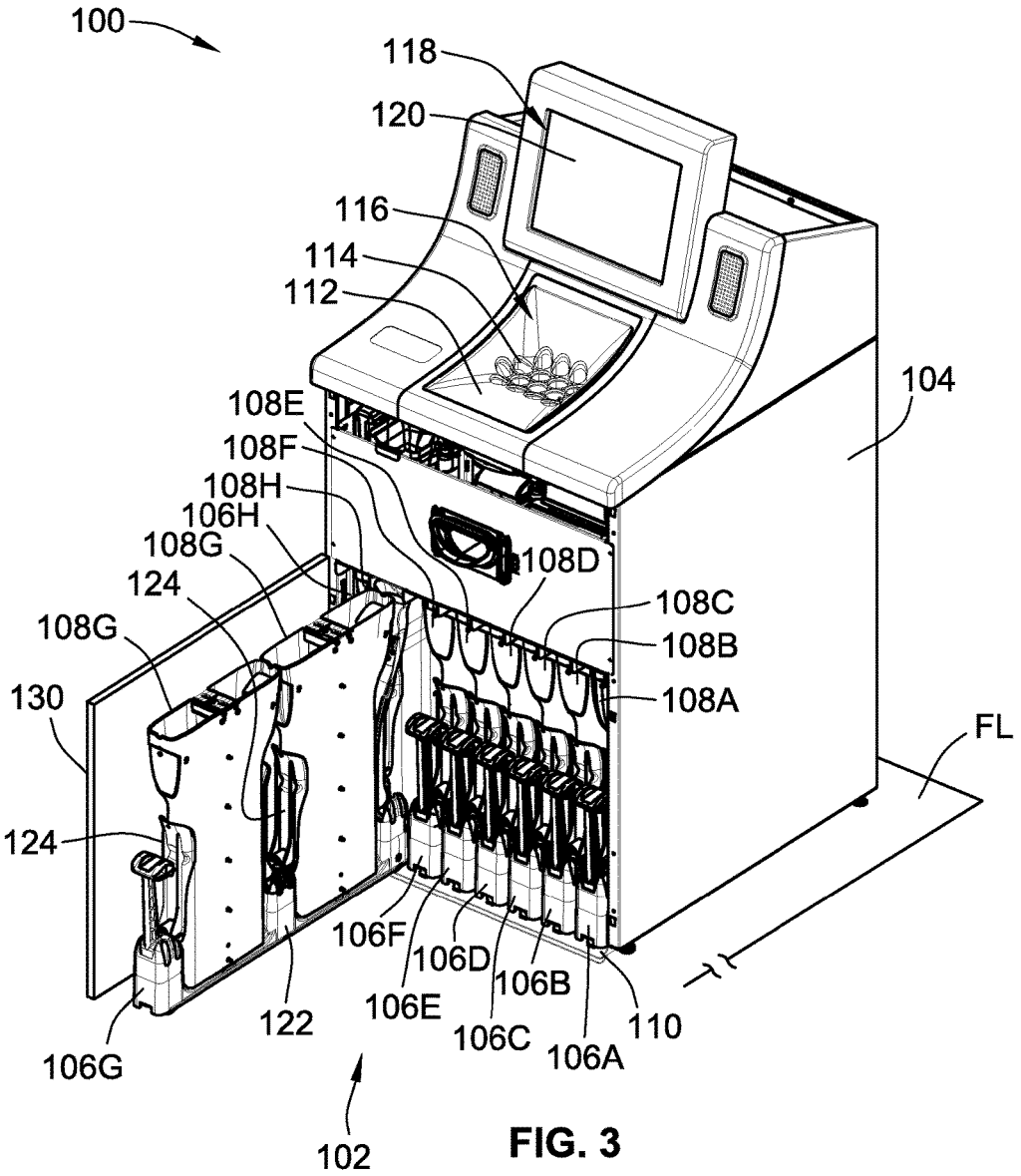
FIG. 3 is a front perspective-view illustration of an example of a coin processing machine in accordance with aspects of the present disclosure.

Another example of a currency processing system is illustrated in accordance with aspects of this disclosure in FIG. 3, this time represented by a coin processing machine 100. The coin processing machine 100 has a coin tray 112 that holds coins prior to and/or during inputting some or all of the coins in the coin tray 112 into the coin processing machine 100. The coin tray 112 may be configured to transfer coins deposited thereon, e.g., by pivoting upwards and/or by downwardly sloping coin surfaces, to a coin sorting mechanism (not visible in FIG. 3; may correspond to coin processing unit 200 of FIG. 4) disposed within a cabinet or housing 104. The coins are transferred from the coin tray 112 to the sorting mechanism, under the force of gravity, via a funnel arrangement 114 formed in a coin input area 116 of the cabinet 104. Once processed, the coin sorting mechanism discharges sorted coins to a plurality of coin bags or other coin receptacles that are housed within the cabinet (or "housing") 104.

A user interface 118 interacts with a controller (e.g., controller 38 of FIG. 2) of the coin processing machine 100. The controller is operable, in at least some embodiments, to control the initiation and termination of coin processing, to determine the coin totals during sorting, to validate the coins, and to calculate or otherwise determine pertinent data regarding the sorted coins. The user interface 118 of FIG. 3 includes a display device 120 for displaying information to an operator of the coin processing machine 100. Like the display device 12 illustrated in FIG. 1, the display device 120 of FIG. 3 may also be capable of receiving inputs from an operator of the coin processing machine 100, e.g., via a touchscreen interface. Inputs from an operator of the coin processing machine 100 can include selection of predefined modes of operation, instructions for defining modes of operation, requests for certain outputs to be displayed on the display device 120 and/or a printer (not shown), identification information, such as an identification code for identifying particular transactions or batches of coins, etc.

During an exemplary batch sorting operation, an operator dumps a batch of mixed coins into the coin tray 112 and inputs an identification number along with any requisite information via the interface 118. The operator (or the machine 100) then transfers some or all of the coins within the coin tray 112 to the sorting mechanism through the coin input area 116 of the cabinet 104. Coin processing may be initiated automatically by the machine 100 or in response to a user input. While the coins are being sorted, the operator can deposit the next batch of coins into the coin tray 112 and enter data corresponding to the next batch. The total value of each processed (e.g., sorted, denominated and authenticated) batch of coins can be redeemed, for example, via a printed receipt or any of the other means disclosed herein.

The coin processing machine 100 has a coin receptacle station 102 disposed within the housing 104. When the coin processing machine 100 is disposed in a retail setting or other publicly accessible environment, e.g., for use as a retail coin redemption machine, the coin receptacle station 102 can be secured inside housing 104, e.g., via a locking mechanism, to prevent unauthorized access to the processed coins. The coin receptacle station 102 includes a plurality of moveable coin-receptacle platforms 106A-H ("moveable platforms"), each of which has one or more respective coin receptacles 108A-H disposed thereon. Each moveable platform 106A-H is slidably attached to a base 110, which may be disposed on the ground beneath the coin processing machine 100, may be mounted to the coin processing machine 100 inside the housing 104, or a combination thereof. In the illustrated embodiment, the coin receptacle station 102 includes eight moveable coin-receptacle platforms 106A-H, each of which supports two coin receptacles 108A-H, such that the coin processing machine 100 accommodates as many as sixteen individual receptacles. Recognizably, the coin processing machine 100 may accommodate greater or fewer than sixteen receptacles that are supported on greater or fewer than eight coin-receptacle platforms.

The coin receptacles 108A-H of the illustrated coin receptacle station 102 are designed to accommodate coin bags. Alternative variations may be designed to accommodate coin cassettes, cashboxes, coin bins, etc. Alternatively still, the moveable platforms 106A-H may have more than one type of receptacle disposed thereon. In normal operation, each of the coin receptacles 108A-H acts as a sleeve that is placed inside of a coin bag to keep coins within a designated volume during filling of the coin bag. In effect, each coin receptacle 108A-H acts as an internal armature, providing an otherwise non-rigid coin bag with a generally rigid internal geometry. Each of the platforms 106A-H includes a coin bag partition 122 that separates adjacent coin bags from one another for preventing coin bags from contacting adjacent coin bags and disrupting the flow of coins into the coin bags. For other embodiments, each moveable platform 106A-H may include multiple partitions 122 to accommodate three or more coin receptacles 108A-H. The moveable platforms 106A-H also include bag clamping mechanisms 124 for each of the coin receptacles 108A-H. Each bag clamping mechanism 124 operatively positions the coin bag for receiving processed coins, and provides structural support to the coin receptacle 108A-H when the moveable platform 106A-H is moved in and out of the machine.

The number of moveable platforms 106A-H incorporated into the coin processing machine 100 can correspond to the number of coin denominations to be processed. For example, in the U.S. coin set: pennies can be directed to the first coin receptacles 108A disposed on the first moveable platform 106A, nickels can be directed to the second coin receptacles 108B disposed on the second moveable platform 106B, dimes can be directed to the third coin receptacles 108C disposed on the third moveable platform 106C, quarters can be directed to the fourth coin receptacles 108D disposed on the fourth moveable platform 106D, half-dollar coins can be directed to the fifth coin receptacles 108E disposed on the fifth moveable platform 106E, dollar coins can be directed to the sixth coin receptacles 108F disposed on the sixth moveable platform 106F. The seventh and/or eighth moveable platforms 106G, 106H can be configured to receive coin overflow, invalid coins, or other rejected coins. Optionally, coins can be routed to the coin receptacles 108A-H in any of a variety of different manners. For example, in the illustrated configuration, if the operator of the coin processing machine 100 is anticipating a larger number of quarters than the other coin denominations, three or more of the coin receptacles 108A-H on the moveable platforms 106A-H may be dedicated to receiving quarters. Alternatively, half-dollar coins and dollar coins, of which there are fewer in circulation and regular use than the other coin denominations, can each be routed to a single dedicated coin receptacle.

In operation, an operator of the coin processing machine 100 who desires to access one or more of the coin receptacles 108A-H unlocks and opens a front door 130 of the housing 104 to access the coin receptacle station 102. Depending on which coin receptacle(s) the operator needs to empty, for example, the operator slides or otherwise moves one of the moveable coin-receptacle platforms 106A-H from a first "stowed" position inside the housing 104 (e.g., moveable platform 106A in FIG. 3) to a second "extracted" position outside of the housing 104 (e.g., moveable platform 106G in FIG. 3). If any of the coin bags are filled and need to be replaced, the operator may remove filled coin bags from the extracted movable platform, replace the filled coin bags with empty coin bags, return the movable platform to the stowed position, and subsequently shut and lock the front door 130.

Figure 4:
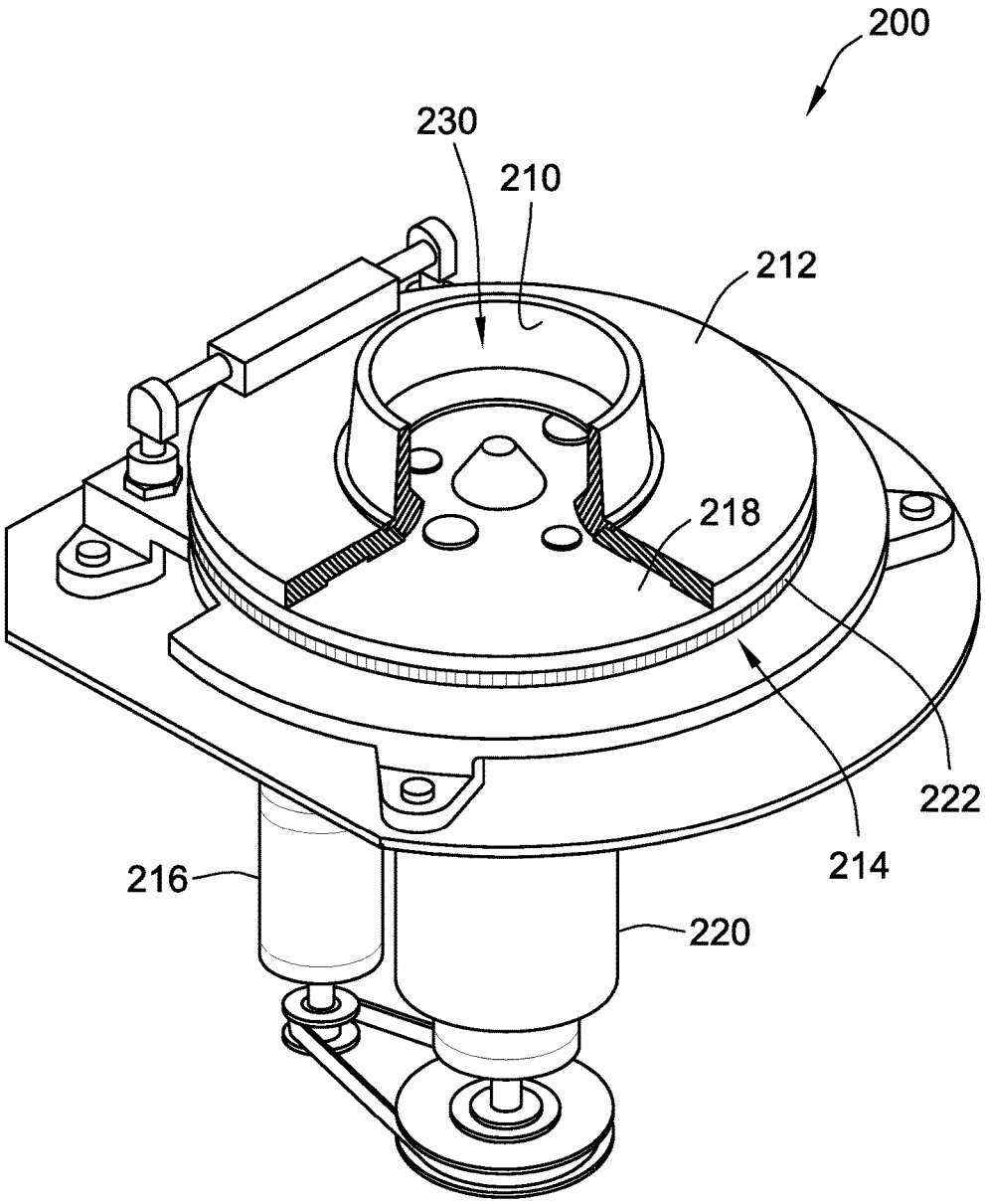
FIG. 4 is a partially broken away perspective-view illustration of an example of a disk-type coin processing unit in accordance with aspects of the present disclosure.

FIG. 4 shows a non-limiting example of a coin sorting device, represented herein by a disk-type coin processing unit 200 that can be used in any of the currency processing systems, methods and devices disclosed herein. The coin processing unit 200 includes a hopper channel, a portion of which is shown at 210, for receiving coins of mixed denominations from a coin input area (e.g., coin input areas 14 or 116 of FIGS. 1 and 3). The hopper channel 210 feeds the coins through a central opening 230 in an annular, stationary sorting head 212 (oftentimes referred to as a "sorting disk" or "sort disk"). As the coins pass through this opening, the coins are deposited onto the top surface of a resilient pad 218 disposed on a rotatable disk 214. According to some embodiments, coins are initially deposited by a user onto a coin tray (e.g., coin tray 112 of FIG. 3) disposed above the coin processing unit 200; coins flow from the coin tray into the hopper channel 210 under the force of gravity.

This rotatable disk 214 is mounted for rotation on a shaft (not visible) and driven by an electric motor 216. The rotation of the rotatable disk 214 of FIG. 4 is slowed and stopped by a braking mechanism 220. The disk 214 typically comprises a resilient pad 218, preferably made of a resilient rubber or polymeric material, that is bonded to, fastened on, or integrally formed with the top surface of a solid disk 222. The resilient pad 218 may be compressible such that coins laying on the top surface thereof are biased or otherwise pressed upwardly against the bottom surface of the sorting head 212 as the rotatable disk 214 rotates. The solid disk 222 is typically fabricated from metal, but it can also be made of other materials, such as a rigid polymeric material.

The underside of the inner periphery of the sorting head 212 is spaced above the pad 218 by a distance which is approximately the same as or, in some embodiments, just slightly less than the thickness of the thinnest coin. While the disk 214 rotates, coins deposited on the resilient pad 218 tend to slide outwardly over the top surface of the pad 218 due to centrifugal force. As the coins continue to move outwardly, those coins that are lying flat on the pad 218 enter a gap between the upper surface of the pad 218 and the lower surface of the sorting head 212. As is described in further detail below, the sorting head 212 includes a plurality of coin directing channels (also referred to herein as "exit channels") for manipulating the movement of the coins from an entry area to a plurality of exit stations (or "exit slot") where the coins are discharged from the coin processing unit 200. The coin directing channels may sort the coins into their respective denominations and discharge the coins from exit stations in the sorting head 212 corresponding to their denominations.

Figure 5:
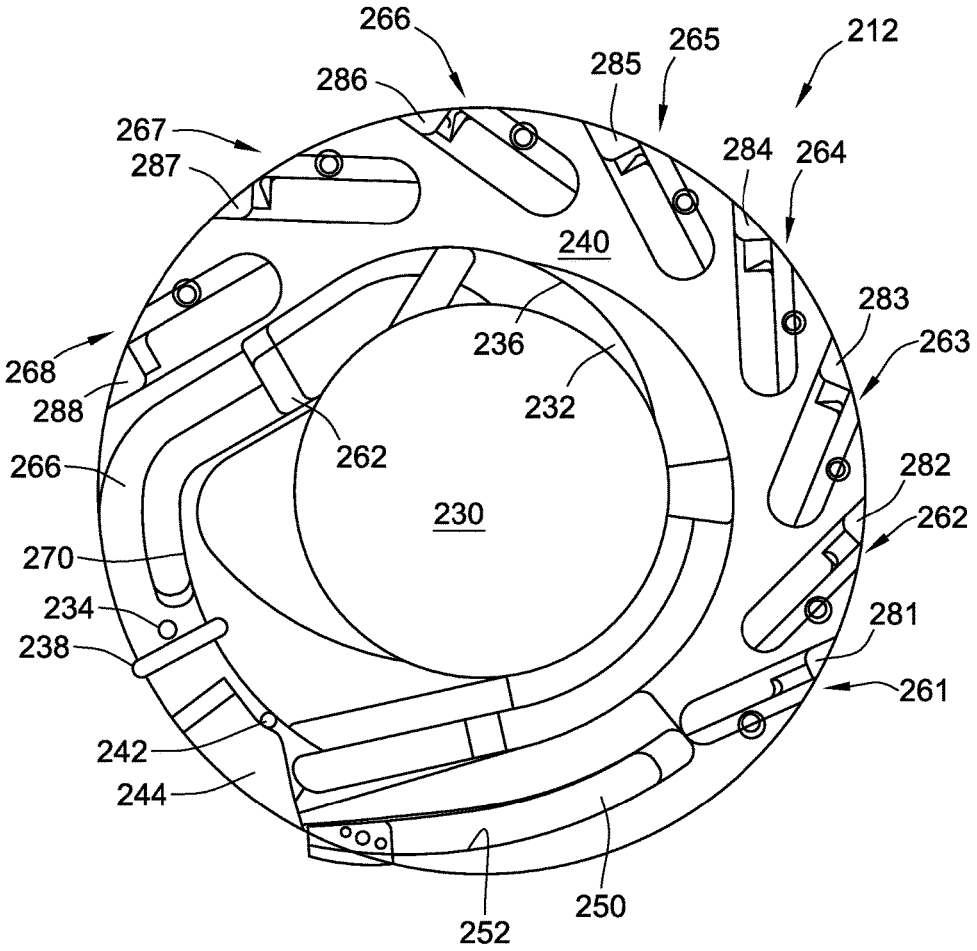
FIG. 5 is an enlarged bottom-view illustration of the sorting head of the exemplary disk-type coin processing unit of FIG. 4.

Referring now to FIG. 5, the underside of the sorting head 212 is shown. The coin set for a given country can be sorted by the sorting head 212 due to variations in the diameter and/or thickness of the individual coin denominations. For example, according to the United States Mint, the U.S. coin set has the following diameters:

Penny=0.750 in. (19.05 mm)
Nickel=0.835 in. (21.21 mm)
Dime=0.705 in. (17.91 mm)
Quarter=0.955 in. (24.26 mm)
Half Dollar=1.205 in. (30.61 mm)
Presidential One Dollar=1.043 in. (26.49 mm)

The coins circulate between the stationary sorting head 212 and the rotating pad 218 on the rotatable disk 214, as shown in FIG. 4. Coins that are deposited on the pad 218 via the central opening 230 initially enter an entry channel 232 formed in the underside of the sorting head 212. It should be kept in mind that the circulation of the coins in FIG. 5 appears counterclockwise as FIG. 5 is a view of the underside of the sorting head 212.

An outer wall 236 of the entry channel 232 divides the entry channel 232 from the lowermost surface 240 of the sorting head 212. The lowermost surface 240 is preferably spaced from the pad 218 by a distance that is slightly less than the thickness of the thinnest coins. Consequently, the initial outward radial movement of all the coins is terminated when the coins engage the outer wall 236, although the coins continue to move more circumferentially along the wall 236 (e.g., in a counterclockwise direction in FIG. 5) by the rotational movement imparted to the coins by the pad 218 of the rotatable disk 214.

While the pad 218 continues to rotate, those coins that were initially aligned along the wall 236 move across the ramp 262 leading to a queuing channel 266 for aligning the innermost edge of each coin along an inner queuing wall 270. The coins are gripped between the queuing channel 266 and the pad 218 as the coins are rotated through the queuing channel 266. The coins, which were initially aligned with the outer wall 236 of the entry channel 232 as the coins move across the ramp 262 and into the queuing channel 266, are rotated into engagement with inner queuing wall 270. As the pad 218 continues to rotate, the coins which are being positively driven by the pad move through the queuing channel 266 along the queuing wall 270 past a trigger sensor 234 and a discrimination sensor 238, which may be operable for discriminating between valid and invalid coins. In some embodiments, the discrimination sensor 238 may also be operable to determine the denomination of passing coins. The trigger sensor 234 sends a signal to the discrimination sensor 238 that a coin is approaching.

In the illustrated example, coins determined to be invalid are rejected by a diverting pin 242 that is lowered into the coin path such that the pin 242 impacts the invalid coin and thereby redirects the invalid coin to a reject channel 244. In some embodiments, the reject channel 244 guides the rejected coins to a reject chute that returns the coin to the user (e.g., rejected coins ejected into the coin reject tube 33 to the coin dispensing receptacle 22 of FIG. 1). The diverting pin 242 depicted in FIG. 5 remains in a retracted "non-diverting" position until an invalid coin is detected. Those coins not diverted into the reject channel 244 continue along inner queuing wall 270 to a gauging region 250. The inner queuing wall 270 terminates just downstream of the reject channel 244; thus, the coins no longer abut the inner queuing wall 270 at this point and the queuing channel 266 terminates. The radial position of the coins is maintained, because the coins remain under pad pressure, until the coins contact an outer wall 252 of the gauging region 250.

The gauging wall 252 aligns the coins along a common outer radius as the coins approach a series of coin exit channels 261-268 which discharge coins of different denominations through corresponding exit stations 281-288. The first exit channel 261 is dedicated to the smallest coin to be sorted (e.g., the dime in the U.S. coin set). Beyond the first exit channel 261, the sorting head 212 shown in FIGS. 4 and 5 forms seven more exit channels 262-268 which discharge coins of different denominations at different circumferential locations around the periphery of the sorting head 212. Thus, the exit channels 261-268 are spaced circumferentially around the outer periphery of the sorting head 212 with the innermost edges of successive channels located progressively closer to the center of the sorting head 212 so that coins are discharged in the order of increasing diameter. The number of exit channels can vary according to alternative embodiments of the present disclosure.

The innermost edges of the exit channels 261-268 are positioned so that the inner edge of a coin of only one particular denomination can enter each channel 261-268. The coins of all other denominations reaching a given exit channel extend inwardly beyond the innermost edge of that particular exit channel so that those coins cannot enter the channel and, therefore, continue on to the next exit channel under the circumferential movement imparted on them by the pad 218. To maintain a constant radial position of the coins, the pad 218 continues to exert pressure on the coins as they move between successive exit channels 261-268.

Further details of the operation of the sorting head 212 shown in FIGS. 4 and 5 are disclosed in U.S. Patent Application Publication No. US 2003/0168309 A1, which is incorporated herein by reference in its entirety. Other disk-type coin processing devices and related features that may be suitable for use with the coin processing devices disclosed herein are shown in U.S. Pat. Nos. 6,755,730; 6,637,576; 6,612,921; 6,039,644; 5,997,395; 5,865,673; 5,782,686; 5,743,373; 5,630,494; 5,538,468; 5,507,379; 5,489,237; 5,474,495; 5,429,550; 5,382,191; and 5,209,696, each of which is incorporated herein by reference in its entirety and for all purposes. In addition, U.S. Pat. Nos. 7,188,720 B2, 6,996,263 B2, 6,896,118 B2, 6,892,871 B2, 6,810,137 B2, 6,748,101 B1, 6,731,786 B2, 6,724,926 B2, 6,678,401 B2, 6,637,576 B1, 6,609,604, 6,603,872 B2, 6,579,165 B2, 6,318,537 B1, 6,171,182 B1, 6,068,194, 6,042,470, 6,039,645, 6,021,883, 5,982,918, 5,943,655, 5,905,810, 5,564,974, and 4,543,969, and U.S. Patent Application Publication Nos. 2007/0119681 A1 and 2004/0256197 A1, are incorporated herein by reference in their respective entireties and for all purposes.

Figure 6:
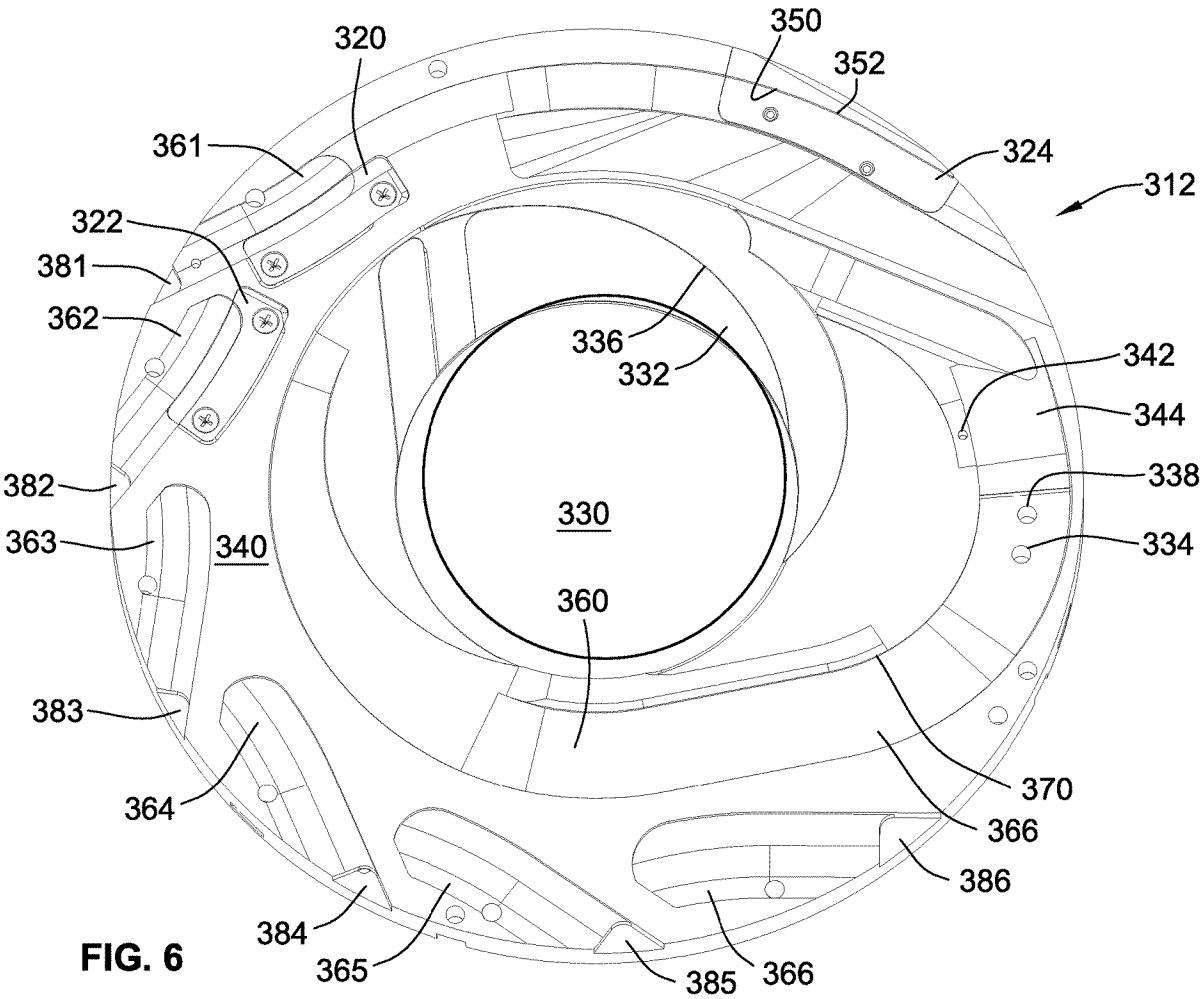
FIG. 6 is an underside perspective-view illustration of a representative annular sorting head of a disk-type coin processing unit with a plurality of exit-channel inserts and a gauging channel insert in accordance with aspects of the present disclosure.

Turning next to FIG. 6, there is shown an annular, stationary sorting head, designated generally as 312, of a disk-type coin processing unit for counting coins, authenticating coins, sorting coins, denominating coins, validating coins, and/or any other form of coin processing. As indicated above, the sorting head 312 of FIGS. 6 and 7 (also referred herein as "sorting disk" or "sort disk") can be incorporated into or otherwise take on any of the various forms, optional configurations, and functional alternatives described herein with respect to the examples shown in FIGS. 1-5 and 8-15, and thus can include any of the corresponding options and features (and vice versa). By way of non-limiting example, the sorting head 312 includes a central opening 330 through which coins are received from a coin hopper or other coin input of a currency processing system (e.g., coin input area 14 of FIG. 1) or coin processing device (e.g., coin tray 112 of FIG. 3). As coins pass through the central opening 330 of the sorting head 312, the coins are deposited onto the top surface of a motor-driven rotatable disk (e.g., onto the resilient pad 218 disposed across the top of the rotatable disk 214 of FIG. 4).

Coins that are deposited on the rotatable disk initially enter an entry channel 332 formed by the underside of the sorting head 312. An outer wall 336 of the entry channel 332 divides the entry channel 332 from the lowermost surface 340 of the sorting head 312, which is spaced from the resilient pad of the rotatable disk. Coins that were initially aligned along the wall 336 are moved across a ramp 360 leading to a queuing channel 366 for aligning the innermost edge of each coin along an inner queuing wall 370. As the resilient pad continues to rotate, the coins are driven through the queuing channel 366 along the queuing wall 370 past a trigger sensor 334 and a discrimination sensor 338, which may be similar in function and operation to the sensors described above with respect to FIG. 5 or any other known coin processing sensors. Coins determined to be invalid are rejected by a diverting pin 342 that is lowered into the coin path such that the pin 342 strikes the invalid coin and thereby redirects the coin to a reject channel 344.

Non-reject coins continue along inner queuing wall 370 to a gauging region 350 (also referred to herein as "gauging channel"). The inner queuing wall 370 and, concomitantly, the queuing channel 366 both terminate just downstream of the reject channel 344. The radial position of the coins, which remain under pad pressure, is maintained until the coins contact an outer wall 352 of the gauging region 350. The gauging wall 352 aligns the coins along a common outer radius as the coins approach a series of coin exit channels 361-366 which cooperatively sort and discharge coins of different denominations through respective exit stations 381-386. Similar to the stationary sorting head 212 of FIG. 5, the first exit channel 361 of the sort disk 312 is dedicated to the smallest coin to be sorted (e.g., the dime in the U.S. coin set). Beyond the first exit channel 361, the sorting head 312 shown in FIGS. 6 and 7 forms five more exit channels 362-366 at different circumferential locations around the periphery of the sorting head 312. The exit channels 361-366 are spaced circumferentially around the sorting head 312 with the innermost edges of successive channels located progressively closer to the center of the sorting head 312 so that coins are discharged in the order of increasing diameter. Each exit channel 361-366 discharges through a respective exit station 381-386 moving coins with a common diameter and, thus, a common denomination. The number of exit channels and exit stations can be increased or decreased from that which is shown in the drawings.

The innermost edges of the exit channels 361-366 are positioned so that the inner edge of a coin of only one particular denomination can enter each channel 361-366. The coins of all other denominations reaching a given exit channel extend inwardly beyond the innermost edge of that particular exit channel so that those coins cannot enter the channel and, therefore, continue on to the next exit channel under the circumferential movement imparted on them by the rotatable disk. To maintain a constant radial position of the coins, the resilient pad continues to exert pressure on the coins as they move between successive exit channels 361-366.

Figure 7:
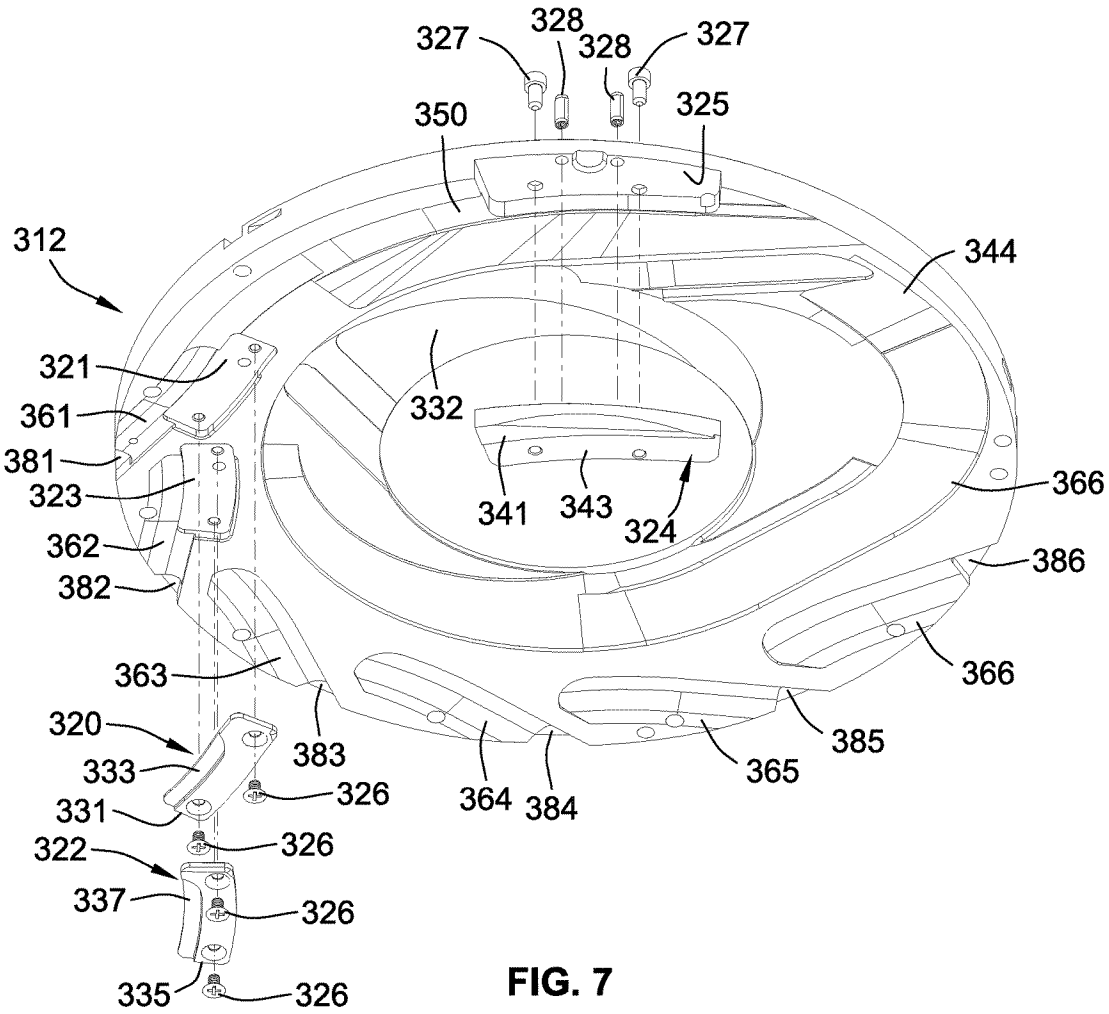
FIG. 7 is a partially exploded underside perspective-view illustration of the sorting head of FIG. 6.

To help extend operational life expectancy, as well as help to minimize premature and uneven wear and offer a cost effective solution for remediating damage and wear, the sorting head 312 illustrated in FIGS. 6 and 7 includes at least one and, in some preferred embodiments, a plurality of replaceable localized inserts that are positioned at high impact points and other important points on the sorting head 312. By way of non-limiting example, the sorting head 312 is provided with three localized inserts: a first exit-channel insert 320 (or "first localized insert") with a first shape and size that is positioned in the first coin exit channel 361; a second exit-channel insert 322 (or "second localized insert") with a second shape and size, which is distinct from the first exit-channel insert 320, that is positioned in the second coin exit channel 361; and a gauging channel insert 324 (or "third localized insert") with a third shape and size, which is distinct from the first and second localized inserts 320, 322, that is positioned in the gauging channel 350. While the embodiment illustrated in FIGS. 6 and 7 is shown comprising three localized inserts, it is certainly within the scope and spirit of the present disclosure to provide the sorting head 312 with greater or fewer inserts. For example, it is contemplated that each of the exit-channels 361-366 be provided with a dedicated, distinctly shaped localized insert. It is further contemplated that the sorting head 312 include any of the other localized inserts described below with respect to FIGS. 8-10, and vice versa.

The sorting head 312 illustrated in FIGS. 6 and 7 defines a variety of recessed insert pockets into which is seated the localized inserts. Namely, a first insert pocket 321, which is recessed into the lower surface of the sorting head 312 adjacent to and partially overlapping with the first coin exit channel 361, nests therein the first localized insert 320. The outer periphery of the first insert pocket 321 is generally coterminous with the outer periphery of the first localized insert 320 to ensure that, once properly seated, the first localized insert 320 is prevented from inadvertently shifting back and forth during coin processing. Likewise, a second insert pocket 323, which is recessed into the lower surface of the sorting head 312 adjacent to and partially overlapping with the second coin exit channel 362, nests therein the second localized insert 322. Like the first insert pocket 321, the outer periphery of the second insert pocket 323 is generally coterminous with the outer periphery of the second localized insert 322 to ensure that, once properly seated, the insert 322 is prevented from inadvertently shifting back and forth during coin processing. A third insert pocket 325 is recessed into the lower surface of the sorting head 312 adjacent to and partially overlapping with the gauging channel 350. The third insert pocket 325 is situated at the outer periphery of the sorting head 312 and securely nests therein the gauging channel insert 324. Each of the inserts 320, 322, 324 is rigidly attached to the sorting head 312 with one or more threaded fasteners—e.g., screws 326 and 327 of FIG. 7—and, optionally, one or more locating pins 328. Other means of attachment are also possible, including press fit configurations, snap fit configurations, magnets, adhesives, etc.

As can be seen in FIGS. 6 and 7, each of the localized inserts has a distinct shape and size which is designed to complement and help define an important portion of the sort disk 312. In particular, the first exit-channel insert 320 has an elongated four-sided body 331 with round-chamfered ("filleted") corners and a recessed step 333 that extends along the length of the body and curves proximate one end of the insert 320. As seen in FIG. 6, when the first exit-channel insert 320 is rigidly secured in the first insert pocket 321, the insert 320 and sort head 312 cooperatively define the first exit channel 361. By comparison, the second exit-channel insert 322 also has an elongated four-sided body 335 with round-chamfered corners; however, the body 335 is partially curved and shorter in length than the first insert body 331 and includes a recessed step 337 that extends only a portion of the length of the body and curves proximate one end of the insert 322. When the second exit-channel insert 322 is rigidly secured in the second insert pocket 323, the insert 322 and sort head 312 cooperatively define the second exit channel 362. The gauging channel insert 324, on the other hand, has an elongated four-sided body 341 that is larger than the other two inserts and only includes two round-chamfered corners, but includes a recessed step 343 that extends the entire length of the body. The gauging channel insert 324, when rigidly secured in the insert pocket 325, cooperatively defines with the sorting head 312 the gauging channel 350. While all of the localized inserts shown in FIGS. 6 and 7 have distinct shapes and sizes, it is also envisioned that one or more or all of the localized inserts have a common shape and/or size.

Figure 11:
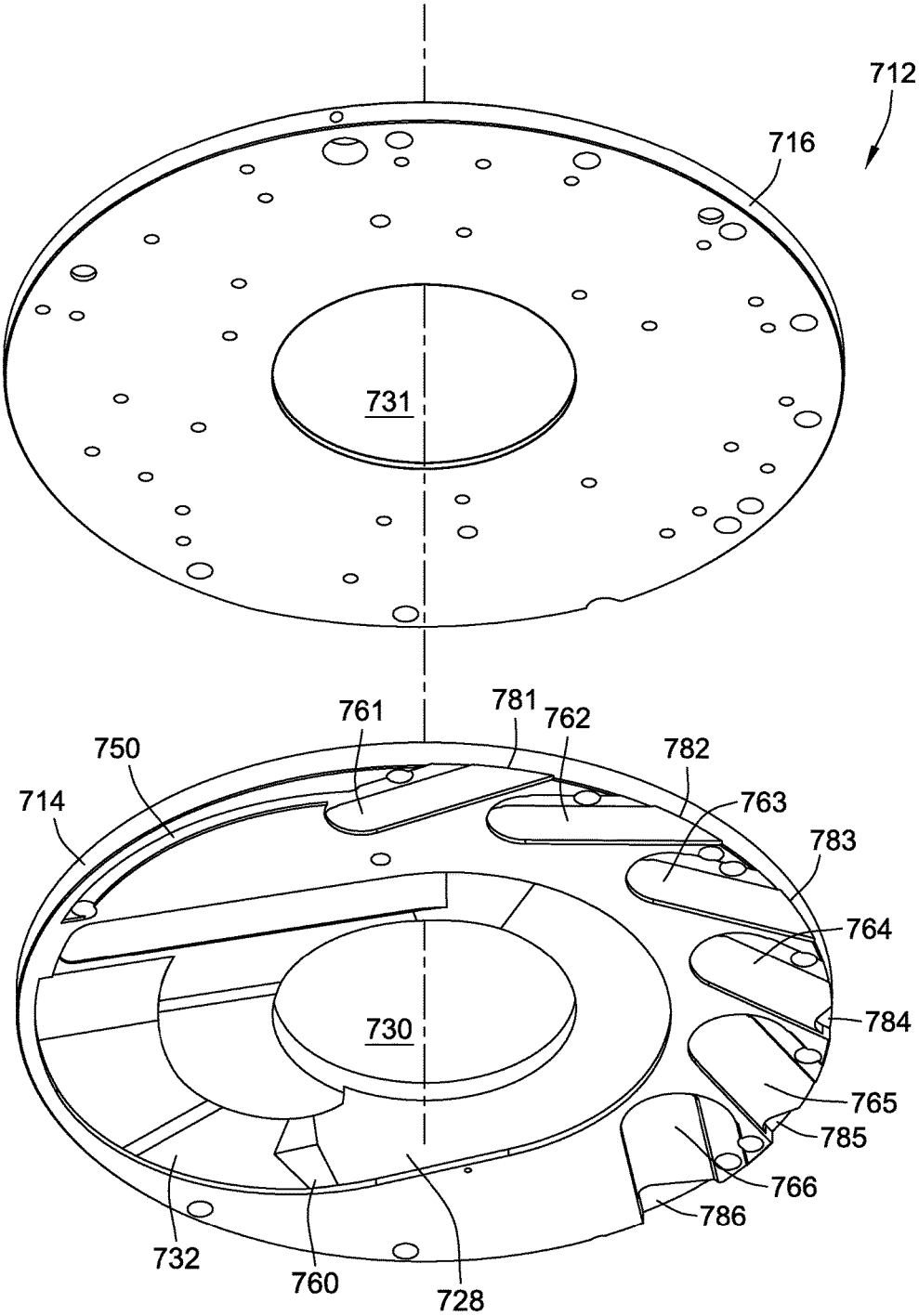
FIG. 11 is a partially exploded underside perspective-view illustration of a representative sorting head with a polymeric annular sorting disk rigidly attached to a rigid backing plate in accordance with aspects of the present disclosure.
Figure 12:
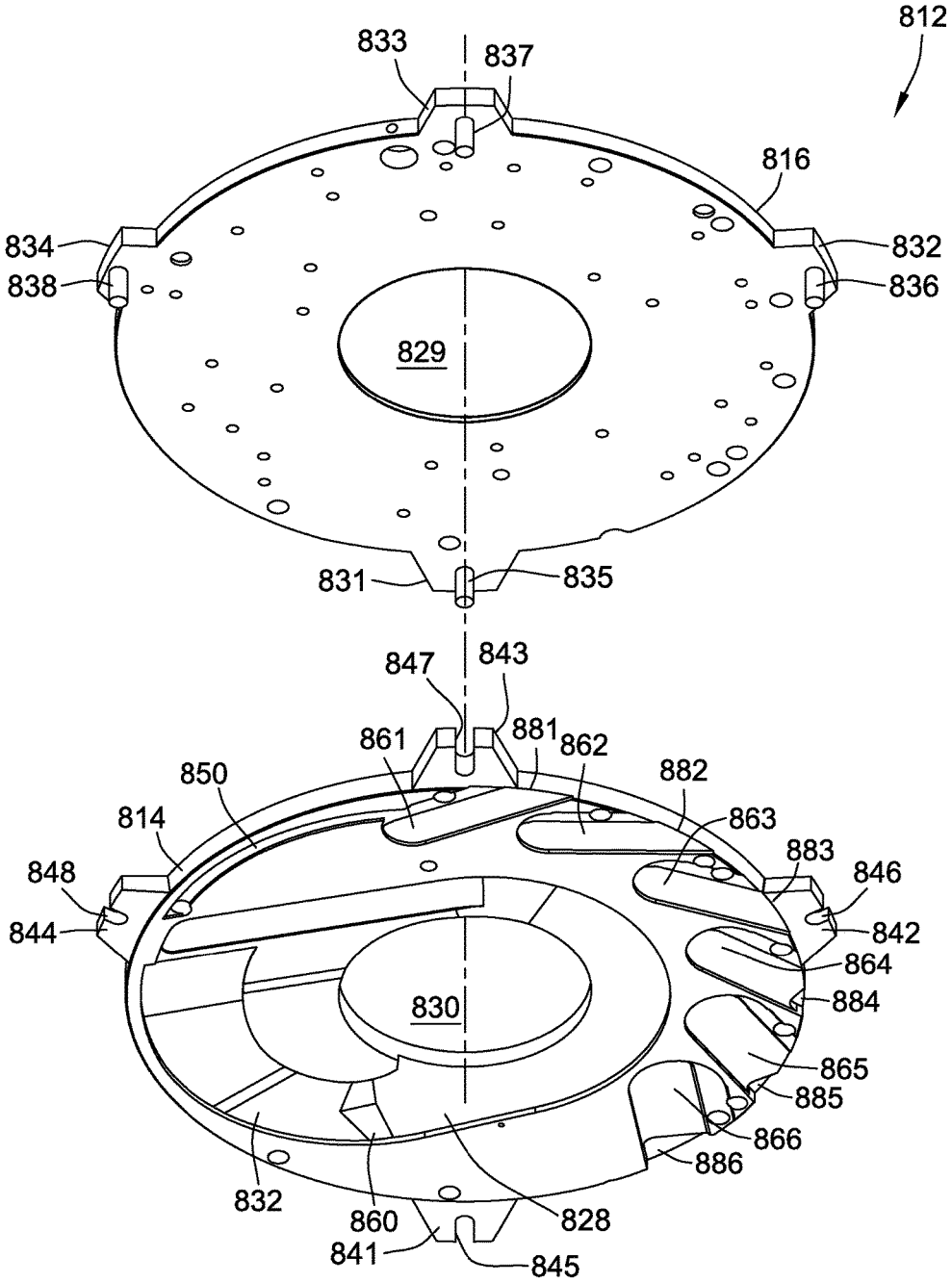
FIG. 12 is a partially exploded underside perspective-view illustration of a representative polymeric annular sorting head overmolded onto a rigid backing plate in accordance with aspects of the present disclosure.

In the embodiment of FIGS. 6 and 7, the three localized inserts 320, 322, 324 are fabricated from a distinctively hard, abrasion and deformation resistant material which is less prone to damage and premature or uneven wear than the material from which the sort disk 312 is fabricated. For instance, the sorting head 312 may be fabricated from a first material (e.g., a heat-treated proprietary steel) and the three localized inserts 320, 322, 324 may be fabricated from a second, distinct material (e.g., tool steel) having a second hardness that is greater than a first hardness of the sort disk 312. According to other aspects of the disclosed concepts, the sorting head 312 of FIG. 6 can be fabricated from a polymeric material (all plastic, such as DELRIN®, TIVAR® or HYDEX®, with or without a metal backing plate or over-mold, e.g., as seen in FIGS. 11 and 12) and comprise various localized inserts that are strategically located at high impact points, critical impact points, areas of high galling, and/or at the exit and queuing channels. These localized inserts can be fabricated from metallic materials, polymeric materials, or any other known abrasion and deformation resistant material with sufficient rigidity and robustness to reduce premature or uneven wear of the sort disk. For some embodiments, the plastic molded sort disk is provided with over-molded localized inserts. In this configuration, the necessary mounting provisions for the inserts can be molded directly into the sort disc. Optionally, inserts of varying materials can be utilized to create necessary friction surfaces and thereby provide localized friction requirements for varying coin control needs. Optionally, the sorting head and inserts are all fabricated from the same material.

Figure 8:
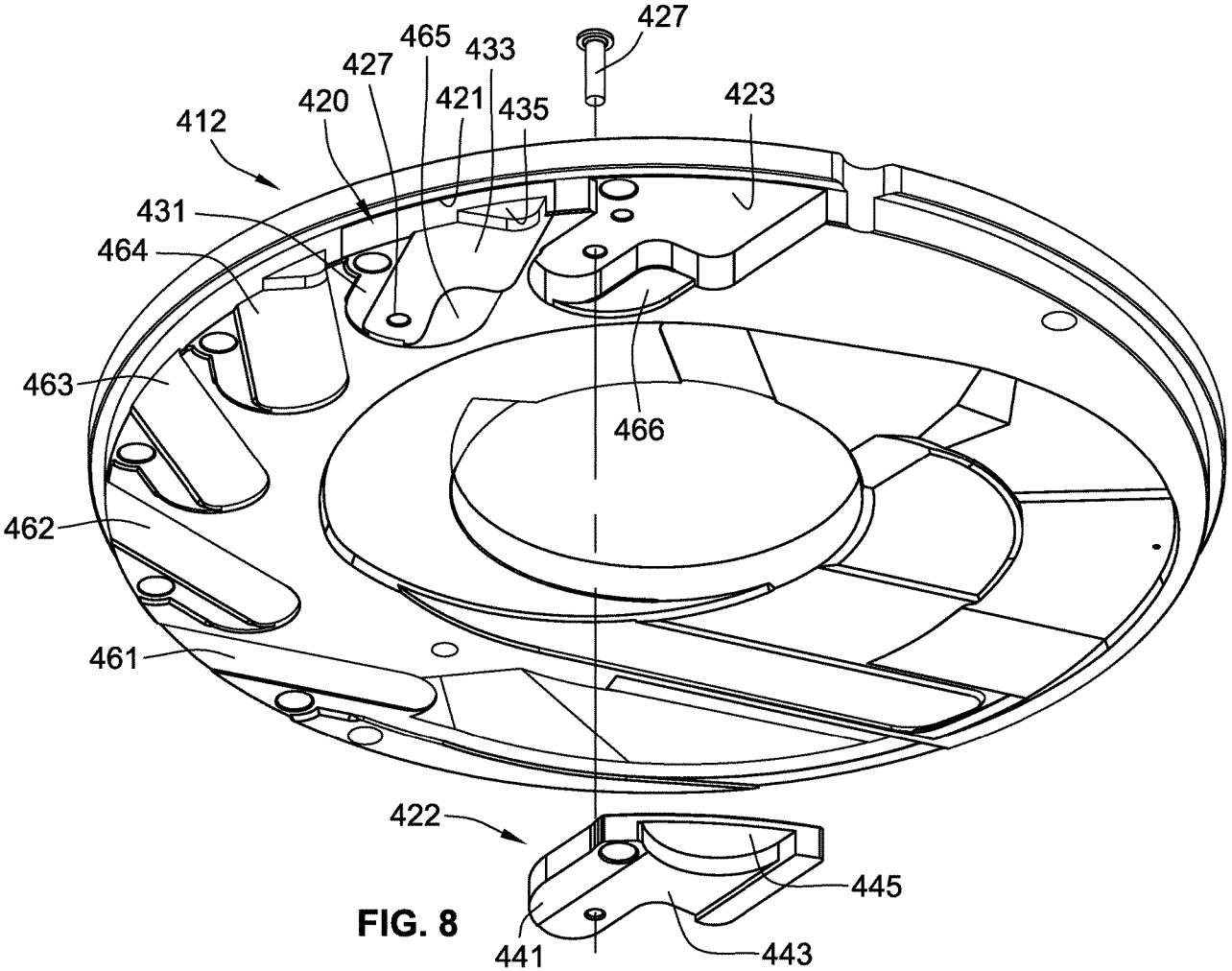
FIG. 8 is a partially exploded underside perspective-view illustration of a representative annular sorting head of a disk-type coin processing unit with a plurality of exit-station inserts in accordance with aspects of the present disclosure.
Figure 9:
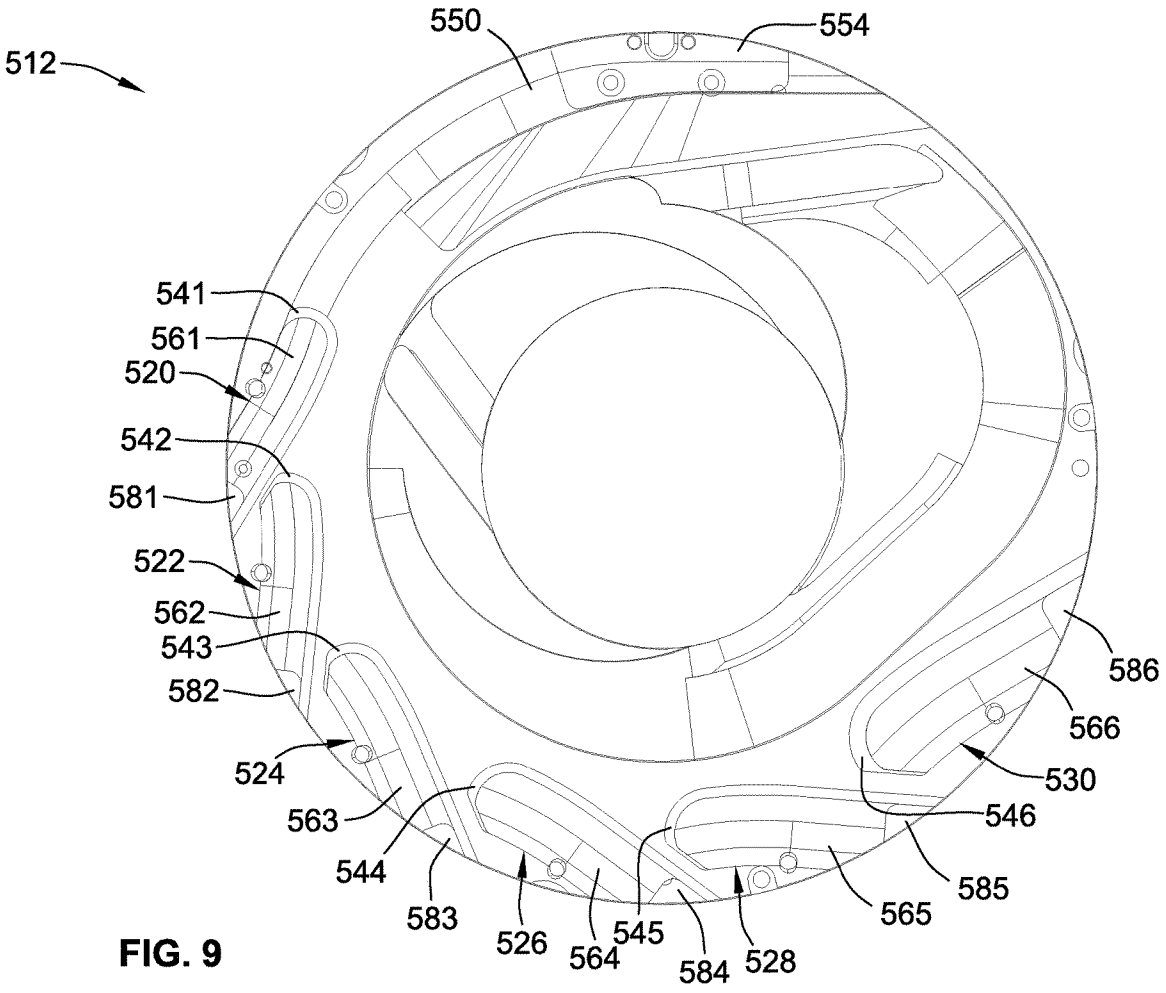
FIG. 9 is an enlarged bottom view illustration of a representative annular sorting head of a disk-type coin processing unit with a plurality of exit inserts and a gauging channel insert in accordance with aspects of the present disclosure.
Figure 10:
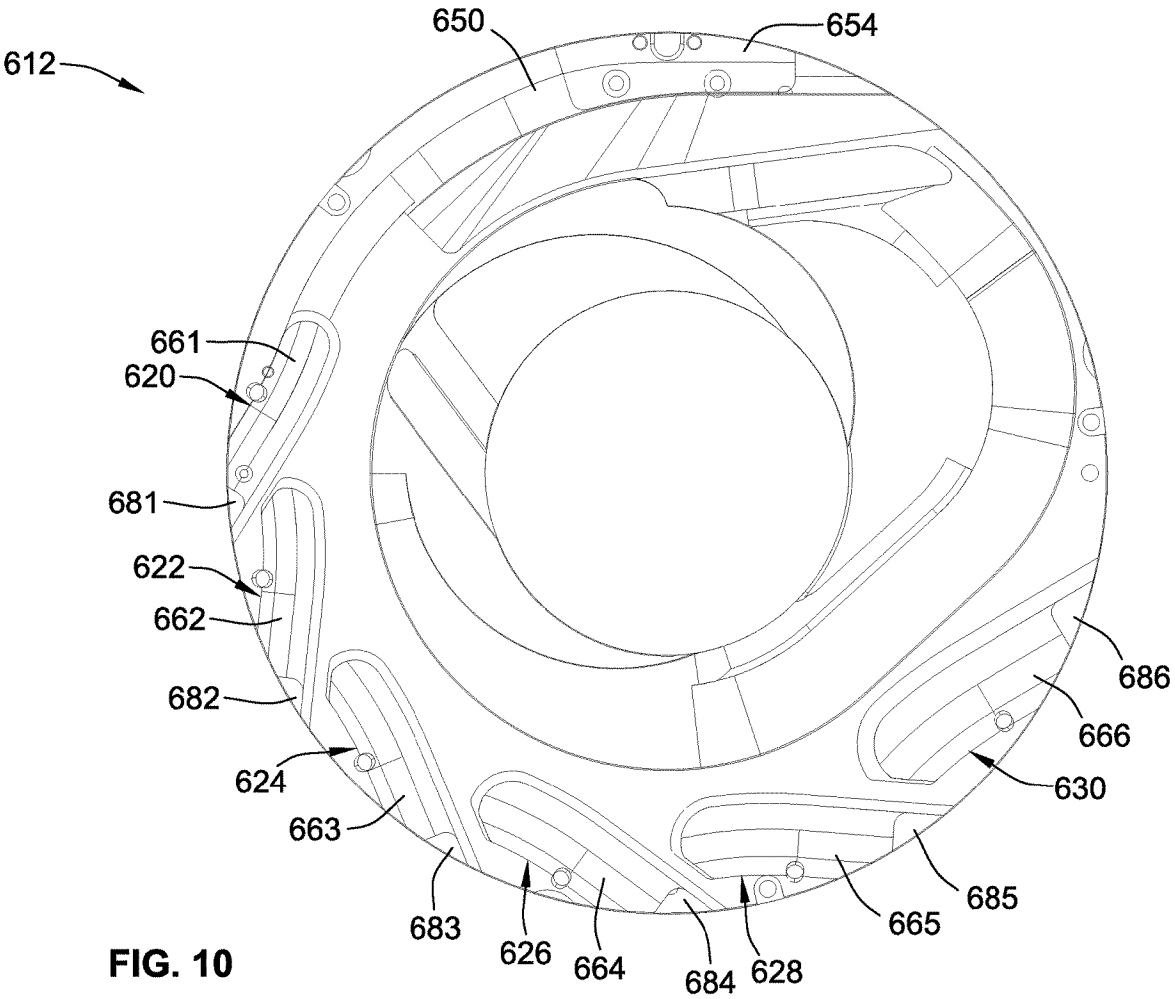
FIG. 10 is an enlarged bottom view illustration of a representative annular sorting head of a disk-type coin processing unit with a plurality of interchangeable exit inserts that allow for coin-set change over in accordance with aspects of the present disclosure.

Shown in FIGS. 8-10 are alternative configurations for annular, stationary sorting heads with localized inserts for disk-type coin processing units. Unless otherwise logically prohibited, the sort disk architectures shown in FIGS. 8-10 may include any of the features, options, and alternatives described above with respect to the architectures shown in FIGS. 5-7 and 11-15, and vice versa. As one specific instance, each of the sorting heads of FIGS. 8-10 may be structurally configured similar to the sorting heads of FIGS. 5 and 6 to sort batches of mixed coins with a network of entry, queuing, gauging and exit channels. For purposes of brevity and succinctness, a description of this structural and functional operability, which was presented above in the discussions of the sorting head 212 of FIGS. 4 and 5 and the sorting head 312 of FIGS. 6 and 7, will not be reiterated hereinbelow.

In order to reduce unwanted galling and, thus, decrease sorting and authentication errors, machine down time and related warranty costs, the sorting head 412 illustrated in FIG. 8 includes at least one and, in some preferred embodiments, a plurality of replaceable localized inserts that are positioned at points determined to exhibit high galling. By way of non-limiting example, the sorting head 412 is provided with two localized inserts: a first exit-station insert 420 that is positioned in the fifth coin exit channel 465; and a second exit-station insert 422 that is positioned in the sixth coin exit channel 466. While the embodiment illustrated in FIG. 8 is shown comprising two localized inserts, it is envisioned that each of the exit-channels 461-466 be provided with a dedicated, distinctly shaped localized insert.

Similar to the sort head architecture illustrated in FIG. 7, the sorting head 412 of FIG. 8 defines a variety of recessed insert pockets into which is seated the localized inserts. Namely, a first exit insert pocket 421 is recessed into the lower surface of the sorting head 412 on the outer perimeter thereof within the fifth coin exit channel 465. The first exit insert pocket 421 nests therein the first exit-station insert 420. The outer periphery of the first exit insert pocket 421 is generally coterminous with the outer periphery of the first exit-station insert 420 to ensure that, once properly seated, the insert 420 is prevented from inadvertently shifting back and forth during coin processing. Likewise, a second exit insert pocket 423, which is recessed into the lower surface of the sorting head 412 on the outer perimeter thereof within the sixth coin exit channel 466, nests therein the second exit-station insert 422. Like the first exit insert pocket 421, the outer periphery of the second exit insert pocket 423 is generally coterminous with the outer periphery of the second exit-station insert 422 to ensure that, once properly seated, the insert 422 is prevented from inadvertently shifting back and forth during coin processing. Each of the inserts 420, 422 is rigidly attached to the sorting head 412 with one or more threaded fasteners (e.g., screws 427).

Each of the localized inserts seen in FIG. 8 has a distinct shape and size which is designed to complement and help define a critical portion of the sort disk 412. In particular, the first exit-station insert 420 has an elongated body 431 with a recessed step 435 at the end of a recessed channel 433 that extends the entire length of the body 431. Once the first exit-station insert 420 is rigidly secured in the first exit insert pocket 421, the insert 420 and sort head 412 cooperatively define the fifth exit channel 465 while the insert 420 defines the exit station thereof. By comparison, the second exit-channel insert 422 has an elongated body 441 with a recessed step 445 at the end of a recessed channel 443 that extends the entire length of the body 441. When the second exit-station insert 422 is rigidly secured in the second exit insert pocket 423, the insert 422 and sort head 412 cooperatively define the sixth exit channel 466 while the insert 422 defines the exit station thereof. While the localized inserts shown in FIG. 8 have distinct shapes and sizes, it is also envisioned that one or more or all of the localized inserts have a common shape and size.

In the embodiment of FIG. 8, the localized inserts 420, 422 are fabricated from distinctively softer, friction reducing materials which are less prone to galling than the material from which the sort disk 412 is fabricated. For instance, the sorting head 412 may be fabricated from a first material (e.g., a heat-treated proprietary steel) with a first hardness and coefficient of friction, and the two localized inserts 420, 422 may be fabricated from a second, distinct material (e.g., low-friction polymer, carbon coated aluminum, etc.) having a second hardness and coefficient of friction that are less than the first hardness and coefficient of friction of the sort disk 412, respectively. While friction requirements may vary for the intended application of a particular sort head, it is generally desirable to lower friction between the sort head and the coins and have higher friction between the resilient pad of the rotating disk and the coins to ensure that the coins can be adequately driven without damaging the sorting equipment or the coins. For low friction applications, the inserts can be fabricated from an assortment of materials including, but not limited to, DELRIN® acetal resin, acrylic, TIVAR® CeramP plastic, Nylon MD-Oil filled cast nylon, TECAPEEK® (PolyEtherKetone), HYDEX® 4101 (4101L), polyurethane, and ZL® 1400 T Bearing Grade PET. In some embodiments, an all-plastic sort disk is provided, which helps to reduce the cost and galling issues associated with all-metal sort disks. The all-plastic sort disk may be fabricated from a variety of known polymers, including polyether ether ketone (PEEK), polybutylene terephthalate (PBT), polyurethane, CeramP, polyethylene terephthalate (PET), polyoxymethylene (POM).

FIG. 9 illustrates another annular, stationary sorting head configuration, designated generally as 512, with localized inserts for disk-type coin processing units. To eliminate the need to replace the entire sorting disk when one or more of the exit channels or exit stations unevenly or prematurely wears, the sorting head 512 illustrated in FIG. 9 includes at least one and, in some preferred embodiments, a plurality of replaceable localized inserts that define the exit channels and exit stations of the sorting head 512. By way of non-limiting example, the sorting head 512 is provided with at least six localized inserts: a first exit insert 520 with a first shape and size that defines the entire first coin exit channel 561 and first exit station 581; a second exit insert 522 with a second shape and size that defines the entire second coin exit channel 562 and second exit station 582; a third exit insert 524 with a third shape and size that defines the entire third coin exit channel 563 and third exit station 583; a fourth exit insert 526 with a fourth shape and size that defines the entire fourth coin exit channel 564 and fourth exit station 584; a fifth exit insert 528 with a fifth shape and size that defines the entire fifth coin exit channel 565 and the fifth exit station 585; and a sixth exit insert 530 with a sixth shape and size that defines the entire sixth coin exit channel 566 and sixth exit station 586. While the embodiment illustrated in FIG. 9 is shown comprising at least six localized inserts, the number of localized inserts can vary according to alternative embodiments of the present disclosure. For instance, an optional gauging channel insert 554, which may be identical to the gauging channel insert 324 of FIG. 6, is positioned in the gauging channel 550 of the sort disk 512.

Although not readily visible in the view provided in FIG. 9, each of the exit inserts 520, 522, 524, 526, 528, 530 is seated within a complementary recessed insert pocket in the sorting head 512. These insert pockets are recessed into the lower surface of the sorting head 512 and spaced circumferentially around the outer perimeter thereof. The outer periphery of each insert pocket is generally coterminous with the outer periphery of the corresponding exit insert seated therein to ensure that, once properly situated, the insert is prevented from inadvertently shifting back and forth during coin processing. Similar to the recessed insert pockets illustrated in FIG. 8, the pockets of FIG. 9 are also sufficiently deep to ensure the exit inserts are either flush with or recessed below the lower surface of the sorting head 512. Each of the inserts 520, 522, 524, 526, 528, 530 is rigidly attached to the sorting head 512 with one or more threaded fasteners and one or more locating pins The localized inserts of FIG. 9 are shown each having a distinctive size and a distinctive shape that is designed to define a critical portion of the sort disk 512. As one example, the first exit insert 520 has an elongated body 541 with a recessed step at the end of an arcuate recessed channel that extends approximately the entire length of the body 541. When the first exit insert 520 is rigidly secured in its corresponding exit insert pocket, the insert 520 defines the first exit channel 561 and the first exit station 581 of the sort disk 512. Likewise, the second, third, fourth, fifth and sixth exit inserts 522, 524, 526, 528, 530 each has an elongated body 542, 543, 544, 545, 546, respectively, with a recessed step at the end of an arcuate recessed channel that extends approximately the entire length of the body. Each insert 522, 524, 526, 528, 530 defines one of the exit channels and exit stations of the sort disk 512.

FIG. 10 is an underside perspective-view illustration of a representative annular sorting head 612 with a plurality of interchangeable exit inserts that allow for coin-set change over. Commensurate with the sorting head configuration presented in FIG. 9, the sorting head 612 illustrated in FIG. 10 includes a plurality of replaceable localized inserts that define all of the exit channels and exit stations of the sorting head 612. In the illustrated example, the sorting head 612 is provided with at least six localized inserts: a first exit insert 620 with a first shape and size that defines the entire first coin exit channel 661 and first exit station 681; a second exit insert 622 with a second shape and size that defines the entire second coin exit channel 662 and second exit station 682; a third exit insert 624 with a third shape and size that defines the entire third coin exit channel 663 and third exit station 683; a fourth exit insert 626 with a fourth shape and size that defines the entire fourth coin exit channel 664 and fourth exit station 684; a fifth exit insert 628 with a fifth shape and size that defines the entire fifth coin exit channel 665 and the fifth exit station 685; and a sixth exit insert 630 with a sixth shape and size that defines the entire sixth coin exit channel 666 and sixth exit station 686.

The localized inserts of FIG. 10 are interchangeable with other localized inserts to allow the user of the coin processing device to process different sets of target coins (e.g., coins from different countries, coins of different denominations, etc.). For purposes of description and clarification, the sort disk 612 of FIG. 10 can be considered to be structurally identical to the sort disk 512 of FIG. 9 except that the exit inserts 620, 622, 624, 626, 628, 630 are shaped and sized to process a first set of target coins (e.g., U.S. coins) while the exit inserts 520, 522, 524, 526, 528, 530 are shaped and sized to process a second set of target coins (e.g., coins from the Bahamas). With this configuration, the user may utilize the sort head and exit inserts of FIG. 10 to process one or more batches of U.S. coins and, by swapping out these inserts for the exit inserts of FIG. 9, process one or more batches of Canadian coins. For some configurations, the sort disk 512 comprises an optional gauging channel insert 654 that is positioned in the gauging channel 650 of the sort disk 612. Like the exit inserts 620, 622, 624, 626, 628, 630, the gauging channel insert 654 is interchangeable with other gauging channel inserts (e.g., gauging channel insert 554 of FIG. 9) to allow the user to process a different set of target coins. For an entire coin set swap, there may be other areas that need to be changed out to accommodate the new coin set. The sort disk architecture presented in FIG. 10 eliminates the need for a customer to have to purchase multiple sort heads to process different sets of target coins.

Turning next to FIG. 11, there is shown an example of a bipartite sorting head architecture 712 which employs a rigid or substantially rigid annular sorting disk 714 that is coupled to and mechanically reinforced with a rigid backing plate 716. Like the configurations illustrated in FIGS. 4-10, the annular sorting disk 714 includes a central opening 730 through which coins are received and deposited onto the top surface of a rotatable disk. Coins that are deposited on the rotatable disk initially enter an entry channel 728 formed by the underside of the sorting head 712. Coins are moved from the entry channel 728 across a ramp 760 leading to a queuing channel 732. Coins continue along from the queuing channel 732 to a gauging channel 750 that aligns the coins as they approach a series of coin exit channels 761-766 which cooperatively sort and discharge coins of different denominations through respective exit stations 781-786.

The annular sorting disk 714, which has a first stiffness and may be fabricated from a first material, such as a rigid polymer, is mechanically coupled with or otherwise rigidly attached to the annular backing plate 716, which has a second stiffness that is greater than that of the sorting disk 714 and may be fabricated from a second material, such as a rigid metallic material. In some configurations, the polymeric annular sorting disk 714 is adhered and/or mechanically fastened to the backing plate 716. For some configurations, a rigid backing plate 716 can be set in a mold, and a polymeric annular sorting disk 714 can be formed, e.g., by injection molding, insert molding, etc., onto the rigid backing plate 716 or mechanically fastened, e.g., via screws, to the rigid backing plate 716. Optionally, the molding process may include generating integrally formed stakes, screws, snap fasteners, or other fastening means to positively couple the polymeric sorting disk 714 to the rigid backing plate 716. In so doing, the rigid backing plate 716 provides the requisite structural integrity and positional stability for the polymeric sorting disk 714.

As can be seen in FIG. 11, the backing plate 716 has a central opening 731 with the same or substantially same inner diameter as the central opening 730 of the polymeric sorting disk 714. In the same regard, the outer diameter of the backing plate 716 is the same or substantially the same as the outer diameter of the sorting disk 714. The rigid backing plate 716 provides the necessary rigidity and alignment indexing needed for a quick replacement of the polymeric sorting disk 714. While the embodiment illustrated in FIG. 11 is a bipartite construction, it is envisioned that the sorting head be segmented into three or more functional segments, each of which may be fabricated from a distinct material and rigidly coupled to the other segments.

Illustrated in FIG. 12 of the drawings is yet another example of a multi-part, multi-material sorting head architecture 812 for a disk-type bulk coin processing unit. The sorting head 812 comprises at least two primary components: a rigid annular sorting disk 814 of a first material that is coupled to and mechanically reinforced by a rigid annular backing plate 816 of a second material. Like the configurations illustrated in FIGS. 4-11, annular sorting disk 814 includes a central opening 829 through which coins are received and deposited onto the top surface of a rotatable disk. Coins that are deposited on the rotatable disk initially enter an entry channel 828 formed by the underside of the sorting head 812. Coins are moved from the entry channel 828 across a ramp 860 leading to a queuing channel 832. Coins continue along from the queuing channel 832 to a gauging channel 850 that aligns the coins as they approach a series of coin exit channels 861-866 which cooperatively sort and discharge coins of different denominations through respective exit stations 881-886.

In the embodiment illustrated in FIG. 12, the annular sorting disk 814 is fabricated from a material with sufficient conformability for readily forming and/or easily machining of the sorting disk channels, contours, and related structural features and to ensure the disk includes all necessary machining stock on surface and perimeters. For at least some configurations, the annular sorting disk 814 is fabricated as a single-piece, unitary structure from a rigid plastic material, such as a high-load, high-speed, abrasion-resistant and wear-resistant thermoplastic polyethylene polymer (e.g., TIVAR® Ceram P®) or other plastic. For at least some embodiments, the material should have sufficient stiffness to resist deflection/distortion under various coin loads—e.g., a Shore D hardness of at least approximately 60 or, in some embodiments, at least approximately 68. According to at least some embodiments, the material has a tensile strength of at least approximately 35 MPa or, in some embodiments, at least approximately 38 MPa. The material may be a pelletized raw material suitable for casting or injection molding, including overmolding. It is desirable, for at least some embodiments, that the material be free-cutting, impact resistant, and self-lubricating. Moreover, the material may offer sufficient thermoplastic or thermosetting properties to support overmolding attachment to the backing plate 816.

Backing plate 816 of FIG. 12 is fabricated, e.g., via molding, casting or machining, as a single-piece, unitary structure from a rigid material, such as cast aluminum or work-hardened steel or other rigid materials sufficient for the intended application of the sorting head architecture. Projecting from the backing plate 816 is a plurality of integrally formed latch platforms 831-834 with connecting pins/screws 835-838, each of which is configured to mate with a respective one of a plurality of integrally formed latch arms 841-844 that projects from the sorting disk 814. When properly mated, the latch arms 841-844 and latch platforms 831-834 with pins/screws 835-838 operatively align and mechanically couple the sorting disk 814 and backing plate 816. While the platforms 831-834 and arms 841-844 may operate as the sole means of attaching or otherwise coupling the disk 814 to the plate 816, it is desirable for at least some embodiments that the sort disk 814 be overmolded onto the backing plate 816. Overmolding the sort disk 814 onto the backing plate 816 helps to reduce or eliminate secondary operation, assembly and labor costs, helps to reduce or eliminate the need for additional bonding and/or coupling steps in the manufacturing process, helps to improve reliability of the sorting head architecture, helps to ensure proper alignment and prevent loosening, improves resistance to vibration and shock, and helps to improve part strength and operational life expectancy. In so doing, a more secure means of attachment is provided thereby ensuring proper functionality and improved performance from the sorting head architecture.

As seen in FIG. 12, latch platforms 831-834, which project radially outward, are positioned circumferentially on the outer periphery of the backing plate 816, with the first, second and fourth latch platforms 831, 832 and 834 being spaced equidistant from one another (e.g., approximately 120 degrees apart). Likewise, latch arms 841-844 also project radially outward and are positioned circumferentially on the outer periphery of the sorting disk 814, with the first, second and fourth latch arms 841, 842 and 844 being spaced equidistant from one another (e.g., approximately 120 degrees apart). With this configuration, the connecting pins/screws 835-838 can be readily aligned with and seated in a corresponding slot 845-848 in a respective one of the latch arms 841-844. In configurations with screws, the attachment may be completed with a nut, spring, washer and stud, all of which are mounted on top of a complementary boss. For some embodiments, the first latch platform 831 cooperates with the first latch arm 841 to provide alignment functionality when coupling together the disk 814 and plate 816, while the third latch platform 833 cooperates with the third latch arm 843 to provides locating functionality when coupling together the disk 814 and plate 816. It is certainly within the scope and spirit of this disclosure to increase or decrease the number of latch plates and latch arms. As another option, it is also possible to include one or more or all of the latch arms on the backing plate and one or more or all of the latch plates on the sorting disk.

By using the architecture illustrated in FIG. 12 and any of the foregoing materials, reshaping the profile of the sorting disk 814 based on various sorting Theories of Operation is enabled. In addition, the architecture illustrated in FIG. 12 and any of the foregoing materials allows the sorting disk, including its structural and functional characteristics, to be more easily modified, for example, to suit different applications. It is also envisioned that the sorting head architecture comprise more than two components, each of which may be fabricated from a single or multiple materials. In this regard, the sorting disk 814 and backing plate 816 are each shown as a single-piece, unitary structure; however, it is also possible that they each be fabricated from multiple parts that are subsequently assembled together.

In the embodiment illustrated in FIG. 12, the backing plate 816 provides the necessary stiffness and positional stability for operation of the sorting disk 814. For at least some embodiments, the backing plate 816 is a tooled part, which may include gravity casting, die casting and injection molding, as some non-limiting examples. It may be desirable, for at least some embodiments, that the rigid backing plate 816 be fabricated from a metallic material, such as steel, stainless steel, zinc, aluminum or, alternatively, a high-strength and rigid structural plastic. The backing plate 816 may incorporate mounting features, suspension features and other functional features necessary for the operation of the sorting head architecture in a disk-type coin processing unit. By way of non-limiting example, the backing plate 816 may include mounting and locating features for machining operations as well as mounting, locating, and support features for installation and operation. The backing plate 816 may be the base for over molding of the sorting disc plastic material.

For at least some embodiments, the life of the sorting disk 814 is expected to be at least approximately five (5) million coins and/or approximately one (1) year of regular to light use. With the illustrated configuration, field refurbishment of the sorting disc is simplified and more cost effective than replacement of the entire assembly, while optional, is no longer necessary. In addition, a worn out sorting disk may be repurposed and reused, e.g., by recovering and resurfacing the sorting disk. Likewise, the backing plate may be reused and, if desired, repurposed for warranty replacements.

In addition to the various attachment options described above (e.g., overmolding and/or (temporary or permanent) mechanical attachment via fasteners such as pins, screws, inserts, etc.), the sorting disk 814 and backing plate 816 can also be coupled together by using adhesive sheet(s) and other forms of lamination, integral mounting contours (e.g., twist lock and pin), magnets (e.g., rare earth magnets embedded into sorting disk to attach to metal backing plate or magnets embedded in a polymeric backing plate). In addition, the backing plate 816 may be configured with one or more or all of the following features and integrated components: a voice coil housing, a sensor support, an interface printed circuit board (PCB) support, a pivot/support, concentricity fixturing, a coin hopper support, and/or a coin hopper. Likewise, the sorting disk 814 may be configured with one or more or all of the following features and integrated components: retention features, coupling features, concentricity establishment features, anti-rotation component and associated mounting features, coin sensing devices and associated mounting features, interface PCB bracket and associated mounting features, coin hopper interface and associated mounting features, latching/support arms, reject actuation device and associated mounting features, pivot/support device, assembly hardware, etc.

Figure 13:
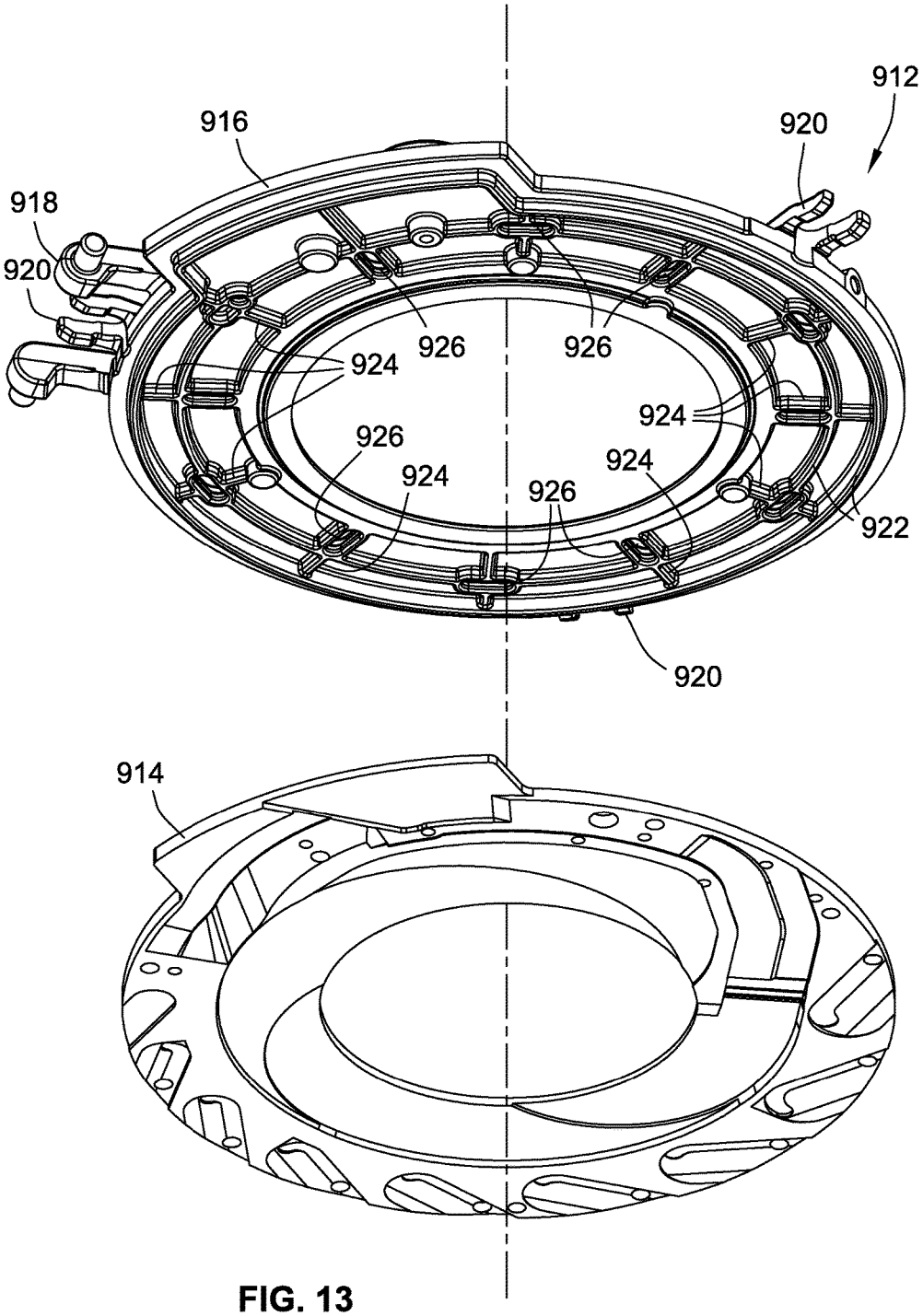
FIG. 13 is a partially exploded underside perspective-view illustration of another representative polymeric annular sorting head overmolded onto a rigid backing plate in accordance with aspects of the present disclosure.

FIG. 13 illustrates another example of a bipartite sorting head, designated generally at 912, which employs a polymeric annular sorting disk 914 that is coupled to and mechanically reinforced by a rigid (metal) annular backing plate 916. Unless otherwise logically prohibited, the sort disk architecture shown in FIG. 13 may include any of the features, options, and alternatives described above with respect to the architectures shown in FIGS. 11 and 12, and vice versa. By way of non-limiting example, the polymeric sorting disk 914 is overmolded onto the backing plate 916. In this example, a mold is designed to overmold the sort disk 914 onto the backing plate 916 within a single molding cycle. The backing plate 916 of FIG. 13 includes a pivot support 918 for movably coupling the sorting head 912 to a complementary bracket structure (not shown) in a coin sorting unit. Three circumferentially spaced sets of positioning arms 920 which project radially outward from the backing plate 916 limit rotation of and help to operatively align the sorting head architecture during operation of the coin sorting unit. To provide additional reinforcement and increased stiffness, a first set of structural reinforcing ribs 922 extends circumferentially along the underside surface of the annular backing plate 816, while a second set of structural reinforcing ribs 924 extends radially along the underside surface of the annular backing plate 816. An assortment of flow channels 926 extend through the backing plate 916 and are configured to receive polymeric material from the sorting disk 914 during the overmolding process to improve the mechanical bond between the disk 914 and plate 918.

Figure 14:
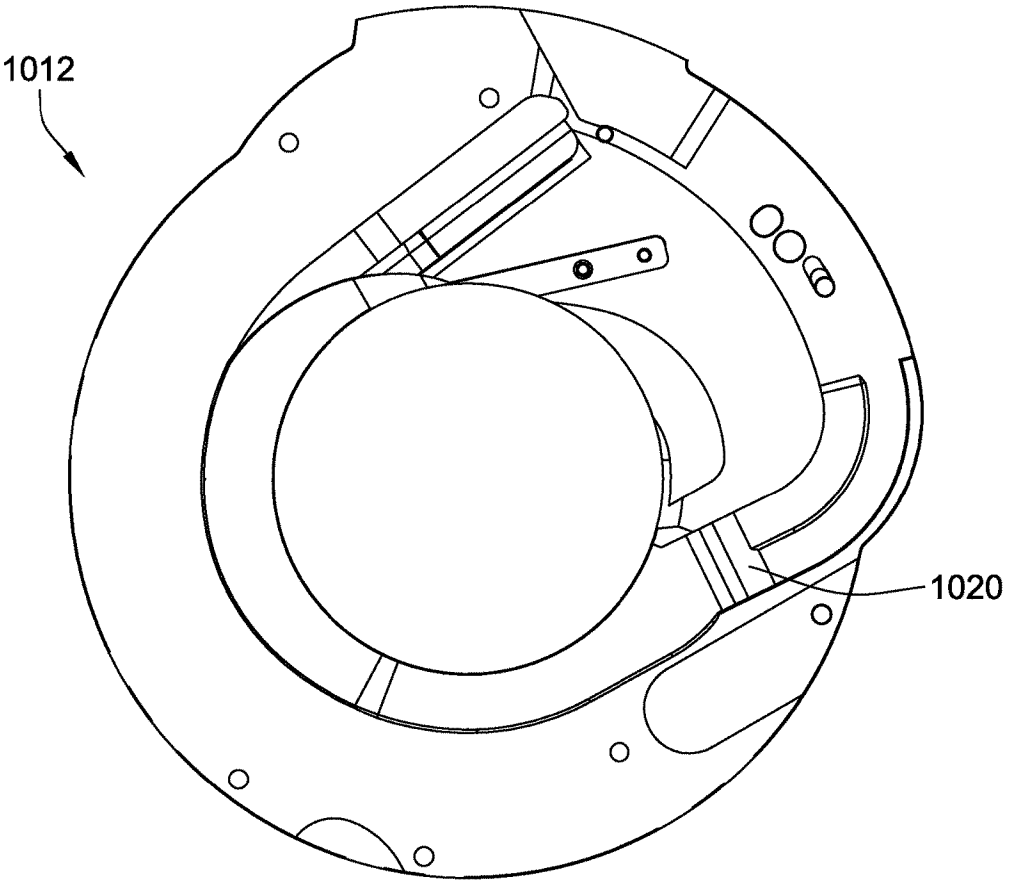
FIG. 14 is an enlarged bottom view illustration of a representative single-exit sorting head of a disk-type coin processing unit with an independent entrance insert in accordance with aspects of the present disclosure.

Illustrated in FIG. 14 is an underside perspective-view illustration of a representative single-exit sorting head 1012 of a disk-type coin processing unit. Within the same gamut of the sort disk architecture shown in FIG. 10, single entrance/exit sort heads can be provided with one or more interchangeable localized inserts—e.g., an independent entrance insert 920—to allow the user of the coin processing device to process different sets of target coins with the same sort disk. In cases of mixed coin applications for single exit sort disks, only one exit is required; however, due to coin set variations, entrance designs may be different. The interchangeable localized entrance insert 920 for the entrance area of the single exit sort disk 1012 allows for a common sort disk to be utilized to process different sets of target coins using dedicated inserts in the entrance.

Figure 15:
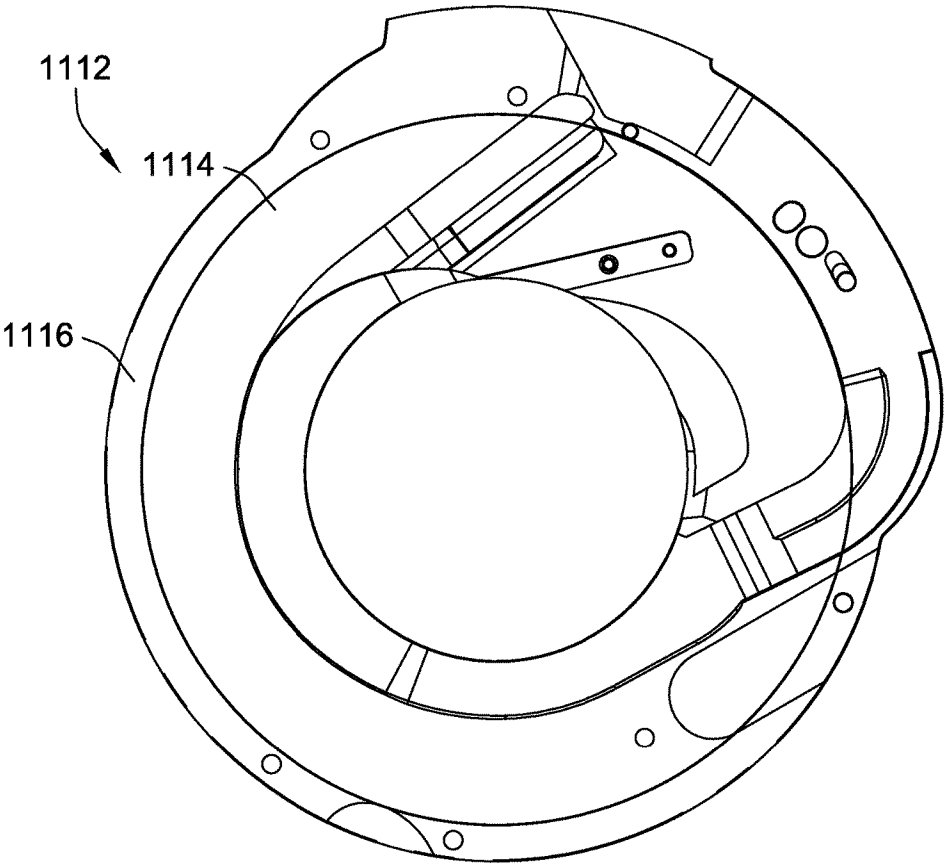
FIG. 15 is an enlarged bottom view illustration of a representative single-exit sorting head of a disk-type coin processing unit with split concentric rings of different materials in accordance with aspects of the present disclosure.

FIG. 15 shows a representative bipartite single-exit sorting head 1112 with split concentric rings of different materials. In particular, the sorting head 1112 comprises an inner sorting ring 1114 of a first material that is rigidly attached to an outer sorting ring 1116 of a second material. For example, a metallic inner sorting ring 1114 for coin entrance and alignment is mechanically fastened to a separate outer polymeric backing ring 1116 for sensing and sorting. This configuration would allow for independent change out of either of these areas, and could utilize varying materials depending on the intended application of the sorting head 1112.

Some of the attendant advantages corresponding to one or more or all of the multi-material sorting disk configurations disclosed herein offer reduced machining and treating time, decreased fabrication costs, a longer operational life expectancy, lower warranty and maintenance costs, and less expensive, easier to replace consumable segments. In some embodiments, the disk-type coin processing units can process approximately 10,000 coins per minute and can provide one or more or all of the following functions: sorting, authenticating, denominating, counting, stripping of double layered coins, re-circulation of genuine coins, rejection of misaligned coins, separation of shingled coins, and rejection of non-genuine coins.

The following exemplary features, options and configurations are not intended to represent every embodiment or every aspect of the present disclosure. Each of the disclosed systems, methods, devices, etc., including those illustrated in the figures, may comprise any of the features, options, and alternatives described herein above and below with respect to the other embodiments, singly and in any combination, unless explicitly disclaimed or logically prohibited.

Aspects of the present disclosure are directed to a currency processing system with a housing, one or more coin receptacles, and a disk-type coin processing unit. The housing is provided with a coin input area for receiving a batch of coins. The one or more coin receptacles are operatively coupled to the housing for stowing processed coins. The disk-type coin processing unit is operatively coupled to the coin input area and the coin receptacle(s) to transfer coins therebetween. This coin processing unit includes a rotatable disk, which is configured to impart motion to a plurality of the coins, and a sorting head, which is configured to sort the coins. The sorting head is fabricated from a first material and has a lower surface that is generally parallel to and at least partially spaced from the rotatable disk. The lower surface forms various shaped regions configured to guide the coins, under the motion imparted by the rotatable disk, to exit channels configured to discharge the coins through exit stations to the one or more coin receptacles. The coin processing unit also has an assortment of localized inserts which are fabricated from a second material that is distinct from the first material of the sorting head. Each of the localized inserts has a distinct shape and is readily removably attached at a distinct one of a plurality of predetermined locations on the sorting head.

For any of the disclosed processing systems, machines and units, the localized inserts can include first and second exit-channel inserts, wherein the first exit-channel insert is shaped to cooperatively define with the sorting head a first of the exit channels, and the second exit-channel insert is shaped to cooperatively define with the sorting head a second of the exit channels. The sorting head can define first and second recessed pockets into which are seated the first and second exit-channel inserts, respectively. The localized inserts can further include a gauging channel insert shaped to cooperatively define with the sorting head a gauging channel. The first material of the sorting head can comprise a first metal having a first hardness, and the second material of the localized inserts can comprise a second metal having a second hardness greater than the first hardness. The localized inserts can include first and second exit-station inserts, wherein the first exit-station insert is shaped to define a first of the exit stations, and the second exit-station insert is shaped define a second of the exit stations. The sorting head can define first and second recessed pockets into which are seated the first and second exit-station inserts, respectively.

For any of the disclosed processing systems, machines and units, the first material of the sorting head can comprise a first material having a first coefficient of friction, and the second material of the localized inserts can comprise a second material having a second coefficient of friction less than the first coefficient of friction. The plurality of localized inserts can include first and second exit inserts, wherein the first exit insert is shaped to define a first of the exit channels and a first of the exit stations, and the second exit insert is shaped to define a second of the exit channels and a second of the exit stations of the sorting head. The sorting head can define first and second recessed pockets into which are seated the first and second exit inserts, respectively. The localized inserts may further include a gauging channel insert that is shaped to cooperatively define with the sorting head a gauging channel.

Aspects of the present disclosure are directed to a coin processing machine that comprises a housing, a plurality of coin receptacles, a processor, and a disk-type coin processing unit. The housing includes an input area that receives therethrough a batch of coins. The coin receptacles, the processor and the disk-type coin processing unit are disposed partially or completely inside the housing. The coin processing unit is operatively coupled to the coin input area and the coin receptacles to transfer coins therebetween. The coin processing unit includes a rotatable disk that supports on an upper surface thereof and imparts motion to coins received from the coin input area. A stationary sorting disk has a lower surface that is generally parallel to and spaced slightly apart from the rotatable disk. This lower surface forms various shaped regions that guide the coins, under the motion imparted by the rotatable disk, from a central region of the sorting disk to a plurality of circumferentially spaced exit channels that sort and discharge the coins through exit stations to the coin receptacles. The stationary sorting disk is fabricated from a first material of a first hardness. Disposed around the sorting disk is a plurality of localized inserts fabricated from a second material of a second hardness, which are distinct from the first material and the first hardness of the sorting disk. Each localized insert has a distinct shape and is readily removably attached at a distinct one of a plurality of predetermined locations on the sorting disk.

Aspects of the present disclosure are directed to a disk-type coin processing unit for a currency processing apparatus. The currency processing apparatus includes a housing with an input area for receiving coins, and one or more coin receptacles for stowing processed coins. The disk-type coin processing unit comprises a rotatable disk for imparting motion to a plurality of the coins. The coin processing unit further comprises a sorting head of a first material with a first hardness having a lower surface generally parallel to and at least partially spaced from the rotatable disk. The lower surface forms shaped regions configured to guide the coins, under the motion imparted by the rotatable disk, to exit channels configured to sort and discharge the coins through a plurality of exit stations to the one or more coin receptacles. Also provided is plurality of localized inserts of a second material with a second hardness, which are distinct from the first material and the first hardness of the sorting head. Each of the localized inserts has a distinct shape and is readily removably attached at a distinct one of a plurality of predetermined locations on the sorting head.

The plurality of localized inserts may comprise first and second exit-channel inserts, wherein the first exit-channel insert is shaped to cooperatively define with the sorting head a first of the exit channels, and the second exit-channel insert is shaped to cooperatively define with the sorting head a second of the exit channels. The sorting head can define insert pockets, each of the localized inserts being seated inside a respective one of the insert pockets. The plurality of localized inserts may comprise a gauging channel insert that is shaped to cooperatively define with the sorting head a gauging channel. The first material of the sorting head may comprise a first metal having a first hardness, and the second material of the localized inserts may comprise a second metal having a second hardness greater than the first hardness. The plurality of localized inserts may comprise first and second exit-station inserts, the first exit-station insert being shaped to cooperatively define with the sorting head a first of the exit stations, and the second exit-channel insert being shaped to cooperatively define with the sorting head a second of the exit stations. The first material of the sorting head may comprise a metal having a first hardness, and the second material of the localized inserts may comprise a polymer having a second hardness less than the first hardness. The plurality of localized inserts may comprise first and second exit inserts, the first exit insert being shaped to define a first of the exit channels and a first of the exit stations, and the second exit insert being shaped to define a second of the exit channels and a second of the exit stations of the sorting head.

The present disclosure is not limited to the precise construction and compositions disclosed herein. Each of these embodiments, including any and all modifications, changes, and variations apparent from the foregoing description, is contemplated as falling within the scope of the invention as defined in the appended claims. Moreover, the present concepts expressly include any and all combinations and subcombinations of the preceding elements and aspects.

What is claimed:

1. A currency processing system comprising:

a housing with a coin input area configured to receive a batch of coins;

one or more coin receptacles operatively coupled to the housing; and a disk-type coin processing unit operatively coupled to the coin input area and the one or more coin receptacles to transfer coins therebetween, the coin processing unit including:

a rotatable disk configured to impart motion to a plurality of the coins, and a stationary multi-part sorting head assembly with an annular sorting disk of a first rigid material attached to an annular backing plate of a second rigid material distinct from the first rigid material, the annular sorting disk having a lower surface generally parallel to and at least partially spaced from the rotatable disk, the lower surface forming a plurality of shaped regions configured to guide the coins, under the motion imparted by the rotatable disk, to a plurality of exit channels configured to sort and discharge the coins through a plurality of exit stations to the one or more coin receptacles;

the annular sorting disk completely encircling a sorting disk central opening;

the annular backing plate completely encircling a backing plate central opening.

2. The currency processing system of claim 1, wherein the first rigid material of the annular sorting disk includes a polymeric material and the second rigid material of the annular backing plate includes a metallic material.

3. The currency processing system of claim 1, wherein the first rigid material of the annular sorting disk is a first polymeric material, and wherein the second rigid material of the annular backing plate is a second polymeric material distinct from the first polymeric material.

4. The currency processing system of claim 1, wherein the annular sorting disk is overmolded onto the annular backing plate.

5. The currency processing system of claim 4, further comprising a plurality of fasteners to mechanically couple the annular sorting disk to the annular backing plate.

6. The currency processing system of claim 1, wherein the annular sorting disk has a first inner diameter and the annular backing plate has a second inner diameter equal to or substantially equal to the first inner diameter.

7. The currency processing system of claim 1, wherein the annular sorting disk has a first outer diameter and the annular backing plate has a second outer diameter equal to or substantially equal to the first outer diameter.

8. The currency processing system of claim 1, wherein the annular sorting disk and the annular backing plate is each fabricated as a single-piece unitary structure.

9. The currency processing system of claim 1, wherein the annular sorting disk is fabricated from a high-load, high-speed, abrasion-resistant and wear-resistant polyethylene polymer.

10. The currency processing system of claim 9, wherein the annular backing plate is fabricated from cast aluminum or work-hardened steel.

11. The currency processing system of claim 1, wherein the annular backing plate includes a plurality of radially projecting latch platforms and the annular sorting disk includes a plurality of radially projecting latch arms, each of the latch platforms being configured to mate with a corresponding one of the latch arms to thereby operatively align and attach the annular backing plate to the annular sorting disk.

12. The currency processing system of claim 11, wherein the latch platforms are integrally formed with and spaced circumferentially about the outer periphery of the annular backing plate, and the latch arms are integrally formed with and spaced circumferentially about the outer periphery of the annular sorting disk.

13. The currency processing system of claim 11, wherein each of the latch platforms includes a pin or screw projecting therefrom, and each of the latch arms defines a slot into which is seated and coupled a respective one of the pins or screws.

14. A coin processing machine comprising:

a housing with an input area configured to receive therethrough a batch of coins;

a plurality of coin receptacles stowed inside the housing;

a processor stored inside the housing; and a disk-type coin processing unit disposed at least partially inside the housing and operatively coupled to the coin input area and the plurality of coin receptacles to transfer coins therebetween, the coin processing unit including:

a rotatable disk configured to support on an upper surface thereof and impart motion to a plurality of coins received from the coin input area; and a bipartite stationary sorting head assembly with a single-piece annular sorting disk fabricated from a first rigid or substantially rigid material of a first hardness and overmolded onto a single-piece annular backing plate fabricated from a second rigid or substantially rigid material of a second hardness, the annular sorting disk having a lower surface generally parallel to and at least partially spaced from the rotatable disk, the lower surface forming a plurality of shaped regions configured to guide the coins, under the motion imparted by the rotatable disk, to a plurality of exit channels configured to sort and discharge the coins through a plurality of exit stations to the one or more coin receptacles;

the annular sorting disk completely encircling a sorting disk central opening;

the annular backing plate completely encircling a backing plate central opening.

15. A disk-type coin processing unit for a currency processing apparatus, the currency processing apparatus including a housing with an input area for receiving coins, and one or more coin receptacles for stowing processed coins, the disk-type coin processing unit comprising:

a rotatable disk configured to impart motion to a plurality of the coins; and a multi-part stationary sorting head assembly with an annular sorting disk of a first rigid material attached to an annular backing plate of a second rigid material distinct from the first rigid material, the annular sorting disk having a lower surface generally parallel to and at least partially spaced from the rotatable disk, the lower surface forming a plurality of shaped regions configured to guide the coins, under the motion imparted by the rotatable disk, to a plurality of exit channels configured to sort and discharge the coins through a plurality of exit stations to the one or more coin receptacles;

the annular sorting disk completely encircling a sorting disk central opening;

the annular backing plate completely encircling a backing plate central opening.

16. The disk-type coin processing unit of claim 15, wherein the first rigid material of the annular sorting disk includes a polymeric material having a first hardness, and the second rigid material of the annular backing plate includes a metallic material having a second hardness greater than the first hardness.

17. The disk-type coin processing unit of claim 15, wherein the annular sorting disk is overmolded onto the annular backing plate.

18. The disk-type coin processing unit of claim 15, wherein the annular sorting disk has a first inner diameter and a first outer diameter, and the annular backing plate has a second inner diameter, which is equal to or substantially equal to the first inner diameter, and a second outer diameter, which is equal to or substantially equal to the first outer diameter.

19. The disk-type coin processing unit of claim 15, wherein the annular sorting disk and the annular backing plate is each fabricated as a single-piece unitary structure.

20. The disk-type coin processing unit of claim 15, wherein the annular backing plate includes a plurality of radially projecting latch platforms and the annular sorting disk includes a plurality of radially projecting latch arms, each of the latch platforms being configured to mate with a corresponding one of the latch arms to thereby operatively align and attach the annular backing plate to the annular sorting disk.

21. The currency processing system of claim 1, wherein the annular sorting disk has a circular inner circumference having a first inner diameter and the annular backing plate has a circular inner circumference having a second inner diameter equal to or substantially equal to the first inner diameter.

22. The currency processing system of claim 21, wherein the annular sorting disk has a generally circular outer circumference having a first outer diameter and the annular backing plate has a generally circular outer circumference having a second outer diameter equal to or substantially equal to the first outer diameter.

23. The currency processing system of claim 1, wherein the annular sorting disk has a generally circular outer circumference having a first outer diameter and the annular backing plate has a generally circular outer circumference having a second outer diameter equal to or substantially equal to the first outer diameter.

24. The currency processing system of claim 1, wherein the annular sorting disk has an outer circumference which is circular over a majority portion of its length, the circular portion of the outer circumference of the annular sorting disk having a first outer diameter, and wherein the annular backing plate has an outer circumference which is circular over a majority portion of its length, the circular portion of the outer circumference of the annular backing plate having a second outer diameter equal to or substantially equal to the first outer diameter.

25. The currency processing system of claim 24, wherein the annular sorting disk has a circular inner circumference having a first inner diameter and the annular backing plate has a circular inner circumference having a second inner diameter equal to or substantially equal to the first inner diameter.

26. The currency processing system of claim 1, wherein the annular backing plate has a lower surface and wherein the annular sorting disk covers all or substantially all of the lower surface of the annular backing plate.

27. The coin processing module of claim 14, wherein the annular backing plate has a lower surface and wherein the annular sorting disk covers all or substantially all of the lower surface of the annular backing plate.

28. The disk-type coin processing unit of claim 15, wherein the annular backing plate has a lower surface and wherein the annular sorting disk covers all or substantially all of the lower surface of the annular backing plate.

* * * * *